US009262977B2

(12) United States Patent
Borgers et al.

(10) Patent No.: US 9,262,977 B2
(45) Date of Patent: Feb. 16, 2016

(54) IMAGE PROCESSING METHOD FOR REDUCED COLOUR SHIFT IN MULTI-PRIMARY LCDS

(71) Applicants: Charlotte Wendy Michele Borgers, Oxford (GB); Benjamin John Broughton, Oxford (GB); Paul Antony Gass, Oxford (GB); Harry Garth Walton, Oxford (GB); John Nonweiler, Oxford (GB)

(72) Inventors: Charlotte Wendy Michele Borgers, Oxford (GB); Benjamin John Broughton, Oxford (GB); Paul Antony Gass, Oxford (GB); Harry Garth Walton, Oxford (GB); John Nonweiler, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 124 days.

(21) Appl. No.: 13/632,270

(22) Filed: Oct. 1, 2012

(65) Prior Publication Data

US 2013/0088528 A1 Apr. 11, 2013

(30) Foreign Application Priority Data

Oct. 6, 2011 (GB) ..... 1117276.4

(51) Int. Cl.
*G09G 3/36* (2006.01)

(52) U.S. Cl.
CPC ..... *G09G 3/3648* (2013.01); *G09G 2300/0452* (2013.01); *G09G 2320/0242* (2013.01); *G09G 2320/0271* (2013.01); *G09G 2320/068* (2013.01)

(58) Field of Classification Search
CPC ..... G09G 3/3648; G09G 2300/0452; G09G 2320/068; G09G 2320/0271
USPC ..... 345/690
See application file for complete search history.

(56) References Cited

U.S. PATENT DOCUMENTS

| | | | | |
|---|---|---|---|---|
| 4,840,460 | A * | 6/1989 | Bernot et al. | 349/144 |
| 5,847,688 | A * | 12/1998 | Ohi et al. | 345/98 |
| 5,956,007 | A | 9/1999 | Ito et al. | |
| 6,020,869 | A | 2/2000 | Sasaki et al. | |
| 6,067,063 | A * | 5/2000 | Kim et al. | 345/89 |
| 6,801,220 | B2 * | 10/2004 | Greier et al. | 345/694 |
| 7,079,214 | B2 * | 7/2006 | Shimoshikiryo | 349/144 |
| 7,113,159 | B2 * | 9/2006 | Sawabe | 345/89 |
| 7,250,957 | B2 * | 7/2007 | Hong | 345/694 |
| 7,474,292 | B2 * | 1/2009 | Kamada et al. | 345/90 |

(Continued)

FOREIGN PATENT DOCUMENTS

| | | |
|---|---|---|
| JP | 08-054860 | 2/1996 |
| JP | 08-069264 | 3/1996 |
| JP | 2003-295160 | 10/2003 |
| JP | 2008-546006 A | 12/2008 |

(Continued)

OTHER PUBLICATIONS

GB Search Report for corresponding GB Application No. 1117276.4 dated Jan. 26, 2012.

(Continued)

*Primary Examiner* — Christopher E Leiby
(74) *Attorney, Agent, or Firm* — Renner, Otto, Boisselle & Sklar, LLP

(57) ABSTRACT

A method of processing an image comprises: receiving pixel data constituting an image, the pixel data including at least four sub-pixel color components having respective data values, and modifying one or more of the sub-pixel color component data values. The data values of corresponding sub-pixels from two pixels are modified in opposite directions to one another and such that the overall luminance of the display panel appears substantially unchanged to an on-axis viewer of the display panel.

34 Claims, 33 Drawing Sheets

(56) References Cited

U.S. PATENT DOCUMENTS

| | | | | |
|---|---|---|---|---|
| 7,764,294 | B2 * | 7/2010 | Lee | 345/690 |
| 2003/0146893 | A1 * | 8/2003 | Sawabe | 345/89 |
| 2004/0061711 | A1 * | 4/2004 | Kurumisawa et al. | 345/698 |
| 2009/0058873 | A1 * | 3/2009 | Brown Elliott et al. | 345/589 |
| 2010/0103206 | A1 * | 4/2010 | Kamada et al. | 345/690 |
| 2010/0156774 | A1 * | 6/2010 | Broughton et al. | 345/88 |
| 2010/0277498 | A1 * | 11/2010 | Elliott et al. | 345/589 |
| 2012/0242719 | A1 * | 9/2012 | Klompenhouwer et al. | 345/690 |

FOREIGN PATENT DOCUMENTS

| | | | |
|---|---|---|---|
| WO | WO 2007/116589 | A1 | 10/2007 |
| WO | WO 2010/071221 | A1 | 6/2010 |

OTHER PUBLICATIONS

E. Lueder, "Liquid Crystal Displays", Wiley and Sons Ltd., 2001.

K. Tomizawa et al., "Invited Paper: Extending the Applications of Multi-Primary Color LCDs", Proceedings of the IDW'09, 2009, pp. 1199-1202.

C.H. Brown Elliott et al., "72.1: Invited Paper: PenTile RGBW Color Processing", SID'08, Digest, pp. 1112-1115.

Thomas L. Credelle, "High-Pixel-Density PenTile Matrix™ RGBW Displays for Mobile Applications", IMID'05, Digest, pp. 867-872.

K. Yoshiyama et al., "19.5L: Late-News Paper: A New Advantage of Multi-Primary-Color Displays", SID'10, Digest, pp. 281-282.

* cited by examiner

FIG. 31

Example : Non-uniform data region

Original pixels

| Pixel (x,y) | Pixel (x,y+1) |
|---|---|
| Data | Data |
| R1 = 200 | R2 = 0 |
| G1 = 50 | G2 = 0 |
| B1 = 50 | B2 = 0 |
| W1 = 50 | W2 = 0 |

Modified pixels according to the process flow diagram illustrated in FIG. 7

| Pixel (x,y) | Pixel (x,y+1) |
|---|---|
| Data | Data |
| R1 = bright = B1 = 255 | R2 = dark = D2 = 0 |
| G1 = bright = B2 = 68 | G2 = dark = D3 = 0 |
| B1 = bright B3 = 76 | B2 = dark = D4 = 0 |
| W1 = dark = D1 = 0 | W2 = bright = B4 = 0 |

absolute[B1-B4] = 255 > threshold
absolute[B2-B4] = 68 > threshold
absolute[B3-B4] = 76 >threshold
absolute[D1-D2] = 0 < threshold
absolute[D1-D3] = 0 <threshold
absolute[D1-D4] = 0 <threshold

IMAGE PROCESSING METHOD FOR REDUCED COLOUR SHIFT IN MULTI-PRIMARY LCDS

This nonprovisional application claims priority under 35 U.S.C. §119(a) on Patent Application No. 1117276.4 filed in the United Kingdom on Oct. 6, 2011, the entire contents of which are hereby incorporated by reference.

FIELD OF THE INVENTION

The present invention relates to a method of and apparatus for processing image data for display by a multi-primary display device.

BACKGROUND OF THE INVENTION

A liquid crystal display (referred to herein as LCD) generally consists of several component parts including but not limited to:

1. A backlighting unit (in the case of a transmissive display) to supply even, wide angle illumination to the panel.
2. Control electronics to receive digital image data and output analogue signal voltages for each pixel, as well as timing pulses and a common voltage for the counter electrode of all pixels. A schematic of the standard layout of LCD control electronics is shown in FIG. 1 (see, E. Lueder, *Liquid Crystal Displays*, Wiley and Sons Ltd., 2001).
3. A liquid crystal (referred to herein as LC) panel, for displaying an image by spatial light modulation, includes two opposing glass substrates, onto one of which is disposed an array of picture element electrodes and an active matrix array to direct the electronic signals, received from the control electronics, to the picture element electrodes. Onto the other substrate is usually disposed a uniform common electrode and colour filter array film. Between the glass substrates is contained a liquid crystal layer of given thickness, usually 2-6 μm, which may be aligned by the presence of an alignment layer on the inner surfaces of the glass substrates. The glass substrates will generally be placed between crossed polarising films and other optical compensation films to cause the electrically induced alignment changes within each picture element region of the LC layer to produce the desired optical modulation of light from the backlight unit and ambient surroundings, and thereby generate the image.

The aforementioned picture elements are commonly referred to as pixels, where each pixel usually consists of a plurality of sub-pixels. Typical LCDs have an RGB stripe geometry, where the pixels are square in shape with three sub-pixels, one red, one green and one blue all of which are shaped as vertical stripes. However, multi-primary displays with pixels containing four or more sub-pixels, for example one red, one green, one blue and one white, are becoming more common.

Multi-primary displays have been produced with the aim to expand the range of displayable colours (Proceedings of the IDW'09, 2009, pp 1199-1202). Multi-primary displays with one red, one green, one blue and one white sub-pixel have been developed with the aim of improving the display brightness and therefore efficiency (SID'08 Digest, pp 1112-1115). Multi-primary displays have also been produced with the aim of simultaneously increasing brightness and increasing the ability to render fine image features on a sub-pixel level (IMID '05 Digest, pp 867-872). Multi-primary displays with one red, one green, one blue and one yellow sub-pixel have also been developed; these displays show enhanced brightness, increased colour gamut, and increased sub-pixel rendering ability (SID'10 Digest, pp 281-282).

As multi-primary displays have more than three types of colour sub-pixels, for many chrominance and luminance values, there may be multiple configurations of individual data values supplied to the colour sub-pixels which produce the same luminance and chrominance overall. The different sets of data values that produce the same overall luminance and chrominance are known as metamers. A method for selecting the most desirable metamer, based on sub-pixel rendering considerations, is described in US 2010 0277498 (published 4 Nov. 2010).

There have been many other advances in LCD technology resulting in very high performance displays with improved metrics such as display area, brightness, image contrast, resolution, bit-depth and response time. However viewing angle characteristics remain poor for many types of LCDs. To achieve good viewing angle characteristics the relationship between the input image data value for a given pixel and the observed pixel luminance, often called the gamma curve, must change as little as possible with viewing angle. The gamma curve of the display is determined by the combined effect of the data-value to signal voltage mapping of the display driver, and the signal voltage to luminance response of the LC panel.

One problematic viewing characteristic is contrast inversion. Contrast inversion occurs when a pixel which has been switched to have a higher luminance than another pixel when observed from a direction normal to the surface of the display (referred to herein as on-axis) does not remain a higher luminance at all viewing angles and consequently the displayed image can appear to invert with changing viewing angle. Several technologies have been developed to solve the contrast inversion problem. For example, displays have been produced with angular compensation films such as the splayed-discotic Wide-View film for Twisted Nematic (referred to herein as TN) displays, multidomained pixels for Vertically Aligned Nematic (referred to herein as VAN) displays, In-Plane Switching (referred to herein as IPS) mode displays and improved electrode geometries.

A second problematic viewing characteristic is the change in perceived colour with viewing angle; this is commonly known as colour shift. Colour shift results from the fact that the amount of luminance variation of a pixel with viewing angle is a function of the on-axis luminance of the pixel. Consequently, in an RGB stripes display where the three sub-pixels have different luminance values, the relative difference in luminance between the three colour components can change with viewing angle. Whilst the contrast inversion problem has widely been solved, colour shift remain a problem for many types of LCDs.

For reasons of clarity, the following examples used to illustrate the colour shift effect and the descriptions of the embodiments to reduce the effect will be directed toward VAN mode LCD displays, with 8 bit per colour gradation control. The problem of colour shift with angle is not restricted to VAN mode displays or displays of any particular colour depth, nor is the applicability of the embodiments described herein, so this should not detract from the scope of the invention, which is applicable to any LCD which exhibits colour shift with angle.

FIG. 2 shows the measured angular dependence of the luminance of a multidomained VAN mode LCD in a mobile phone display, at shades of grey from input data level=0 (black) to 255 (white) in steps of 32. FIG. 3(*a*) shows the points of FIG. 2 at 0° and 50° inclination to the right hand side (horizontal in the orientation in which the display is normally observed) plotted against the input data level. The on-axis curve is the display gamma curve which is designed to approximately follow the relationship $$\frac{L}{L_{max}} = \left(\frac{D}{D_{max}}\right)^{\gamma}$$

where L is the output luminance, for a given data level D, and γ (gamma) is the power relating the two when each is normalised to their maximum value. The gamma value is typically engineered to be in the region of 2.0 to 2.4, and is approximately 2.3 for the display shown in FIGS. 2 and 3.

FIG. 3(*b*) shows the luminance of the display at 0° and at 50° as a function of the on-axis luminance, both are normalised to their maximum values.

From the figures it can clearly be seen that the typical behaviour for a VAN mode display is for mid-grey levels to appear disproportionately bright when viewed off-axis. This is further illustrated in FIG. 4, which shows the luminance as a function of viewing angle, normalised to the luminance of the data=255 state at each angle, for the same VAN mode display displaying input data values equal to 255, 160 and zero. From this figure, it can be seen that if a pixel was input with data=255 to the red colour sub-pixel, with data=160 to the green colour sub-pixel and with data=0 to the blue colour sub-pixel, on-axis, the ratio of normalised luminances is approximately 1:0.35:0 for R:G:B, which would result in an orange coloured appearance for the pixel. However, when viewed from a 50° inclination, the ratio of colour components is approximately 1:0.77:0.03, which would result in a yellow appearance for the pixel. This is the cause of the colour-shift with viewing angle, and it can be seen that, for VAN mode displays in particular, the degree of colour shift is greatest for colours which are composed of one colour component near maximum luminance, and one or two colour components in the mid-luminance range.

Several technologies have been developed to mitigate the effect of colour shift. The most effective of these utilise a split sub-pixel architecture, whereby each colour sub-pixel in the display consists of two or more regions. Each sub-pixel region has a different luminance, one higher than the other; consequently each sub-pixel region has a different variation in luminance with viewing angle. Sub-pixel region luminance values are chosen so that the average on-axis luminance of the sub-pixel regions has the desired overall luminance and so that the average change in luminance with viewing angle of sub-pixel regions is less pronounced than each region taken individually.

This method is known as partial spatial dither or digital halftoning, and can be implemented using a capacitive potential divider between the regions of the split sub-pixel, as described in U.S. Pat. No. 4,840,460 (published 20 Jun. 1989), and U.S. Pat. No. 7,474,292 (published 6 Oct. 2005), or it can be implemented by using an additional source line per colour sub-pixel, such that each of the two regions of the sub pixel receives an independently controlled signal voltage when they are activated by a common gate line. This second implementation is described in U.S. Pat. No. 6,067,063 (published 23 May 2000). The two general approaches are also summarised in U.S. Pat. No. 7,079,214 (published 18 Jul. 2006), in addition this patent also describes how to optimise the relationship between the voltages applied to the brighter and darker sub-pixel regions so as to achieve reduced colour shift.

However, there are negative aspects to the hardware split sub-pixel architecture. Added pixel electronics are required which increases the cost of the display and the method is not applicable to high resolution, small area displays.

It is not necessary to have a split sub-pixel architecture to implement such a method. The technique can effectively be implemented in software, or in the LCD control electronics, and applied to any existing colour display by adjusting the luminance of whole colour sub-pixels up and down alternately, either in the spatial or temporal domain, to create the same effect at the expense of the effective resolution of the display. Luminance is effectively transferred between identical sub-pixels of neighbouring pixels; this is done in such a way so as to ensure the average on-axis luminance of the neighbouring pixels is unchanged whilst the average colour shift is improved. This is described in U.S. Pat. No. 6,801,220 (published 17 Oct. 2002), U.S. Pat. No. 7,113,159 (published 7 Aug. 2003), U.S. Pat. No. 5,847,688 (published 8 Dec. 1998), U.S. Pat. No. 7,250,957 (published 31 Jul. 2007), US 2004 0061711 (published 1 Apr. 2004), US 2010 0156774 (published 24 Jun. 2010) and U.S. Pat. No. 7,764,294 (published 10 Aug. 2006).

In U.S. Pat. No. 6,801,220, this is implemented on an RGB display by an image processing method in which the image data input to the LCD is manipulated by means of a look-up table (referred to herein after as LUT), so that for each input data level, a pair of output data levels is provided which, when displayed by neighbouring pixels on the LCD, are averaged by the eye of the viewer, assuming sufficient display resolution and viewing distance, to appear the same as if the original input data level were displayed on both pixels. The image processing method therefore alternates spatially across the display which of the pair of output data values is applied to each pixel for a given input data value.

U.S. Pat. No. 7,113,159 describes a liquid crystal display device composed of three sub-pixels, red, green and blue, with an excellent graduation curve with wide viewing angle. The wide viewing angle is achieved by adjusting the luminance of the sub-pixels up and down in the temporal domain. In other words, the frames in one pixel display respectively different graduations. The frame switching performed at a sufficiently high speed causes a colour mixture to occur by image persistence, and the colour appears a middle luminance to the eye. The patent also describes a type of hardware split sub-pixel architecture but highlights two problems with the method, the first being the increase in pixel electronics and the second being the reduced transmittance of the sub-pixels. A non-hardware split solution to these problems is suggested whereby a white sub-pixel is added to each pixel. The viewing angle is then improved by correcting the graduation characteristic with respect to the combination of red, green and blue.

However, there are also negative aspects to the software split sub-pixel architecture. Whilst no added pixel electronics are required as in the hardware split sub-pixel architecture and the software method can be applied to high resolution, small area displays the resulting images do suffer from an effective loss in luminance resolution. The chrominance of each individual pixel may also differ from its original value which can lead to colour artefacts in the resulting image. U.S. Pat. No. 6,801,220 states that the halftoning pattern used will have the same overall appearance as the original image only if the image content changes gradually from pixel to pixel. If the image content changes sharply from pixel to pixel, then the halftoning pattern is disrupted. For example, the patent states that a 2×2 sub-pixel pattern can be used where the periodicity of the pattern is two pixels in both the horizontal and vertical directions. The brightened or darkened regions consist of either a single sub-pixel or a pair of sub-pixels. FIG. 5 shows the green/magenta colour arrangement for this pattern. If this pattern is applied to a one pixel by one pixel chequer board image the halftoning pattern is disrupted and colour artefacts are visible. FIGS. 6(*a*) and 6(*b*) illustrate how an original image with a 1×1, grey/black chequer board appears when the green/magenta colour arrangements of the aforementioned pattern is applied to the image. Green and magenta artefacts are visible. Single pixel diagonal lines also suffer from similar colour artefact problems. (The "+" and "−" signs in the sub-pixels of FIGS. 5, 6(*a*) and 6(*b*) indicate the polarity of the voltage applied to that sub-pixel in one frame, with the polarity of the voltage applied to a sub-pixel being reversed from one frame to another as is common for driving an LC display.)

US 2010 0156774 describes a frame inversion drive method with no apparent resolution loss in either luminance or chrominance for static images. In this drive method the bright-dark spatial chequer pattern is imposed in the image within each frame, but the chequer pattern is inverted with each frame change. To the observer, the image of each frame appears identical due to the spatial averaging of the eye making it impossible to discern which of a pair of pixels has been made brighter or darker within a given frame. The key advantage of this frame inversion drive method is that although the macroscopic appearance of each frame, for a static input image, is identical, each pixel is made to change in brightness from frame to frame so as to provide an average luminance over time equal to the desired luminance corresponding to the input data value to that pixel. Therefore, although within each frame a resolution loss is incurred due to the data modifications applied imposing the bright-dark chequer pattern, over a period of two frames or more, each individual pixel provides the correct average luminance, so no apparent resolution loss is incurred.

Whilst it is true that the aforementioned frame inversion drive method can recover some of the luminance resolution loss and no colour artefacts are visible in static image, movement of the eye around the display or blinking can lead to an instantaneous glimpse of the display and consequently at this moment the loss in resolution is still visible; although it must be noted that colour artefacts are not visible during an instantaneous glimpse of the display.

Despite the fact that colour artefacts are not visible when the frame inversion drive method is applied to static images, colour artefacts are visible in some moving images. For example when the modification pattern illustrated in FIG. 5 is applied to a one pixel by one pixel chequer board moving horizontally at a rate of one pixel per frame, colour artefacts are visible even when the frame inversion drive method is applied.

US 2010 0156774 describe a method that can be used to solve the problem of coloured artefacts in moving images. The method involves preventing any modifications being performed on the input image in regions where colour artefacts would result. Whilst the method does prevent coloured artefacts in both static and moving images, the method has the disadvantage that any pixels where the modifications have been prevented do not have any improvement in their off-axis appearance. As a result, identical input pixels where modifications have been applied to one and not to the other appear different to an off-axis viewer. The method also has the additional disadvantage that extra resource is required to implement it. Consequently it would be preferable that no colour artefacts occur in the first place.

It is therefore clear that a requirement exists for an optimised method of reducing colour shift with viewing angle in LCDs where there is no luminance resolution loss or reduced luminance resolution loss compared to the existing methods as well as no colour artefacts for both moving and static images.

SUMMARY OF THE INVENTION

A first aspect of the present invention provides a method of processing an image for display, the method comprising: obtaining pixel data constituting an image, the pixel data including at least four sub-pixel colour components having respective data values, and modifying one or more of the sub-pixel colour component data values; wherein the method comprises modifying the data values of corresponding sub-pixels from a pair of pixels in opposite directions to one another and such that the overall luminance and perceived image of the display panel appear substantially unchanged to an on-axis viewer of the display panel.

A second aspect of the present invention provides a method of processing an image for display, the method comprising: receiving pixel data constituting an image, the pixel data including at least four sub-pixel colour components having respective data values, and modifying one or more of the sub-pixel colour component data values; wherein the method comprises modifying data values for the primary sub-pixels of a pixel and for the non-primary sub-pixel(s) of the pixel such that the overall change in luminance of the primary sub-pixels is approximately equal and opposite to the overall change in luminance of the non-primary sub-pixel(s) whereby the overall luminance of the pixel and the perceived image appear substantially unchanged to an on-axis viewer.

A third aspect of the present invention provides a control circuit for a multi-primary display panel, the control circuit being adapted to receive pixel data constituting an image, the pixel data including at least four sub-pixel colour components having respective data values; and modify one or more of the sub-pixel colour component data values;

wherein the control circuit is adapted to modify the data values of corresponding sub-pixels from a pair of pixels in opposite directions to one another and such that the overall luminance of the display panel and the perceived image appear substantially unchanged to an on-axis viewer of the display panel.

A fourth aspect of the present invention provides a control circuit for a multi-primary display panel, the control circuit being adapted to receive pixel data constituting an image, the pixel data including at least four sub-pixel colour components having respective data values; and modify one or more of the sub-pixel colour component data values;

wherein the control circuit is adapted to modify data values for the primary sub-pixels of a pixel and for the non-primary sub-pixel(s) of the pixel such that the overall change in luminance of the primary sub-pixels is approximately equal and opposite to the overall change in luminance of the non-primary sub-pixel(s) whereby the overall luminance of the pixel and the perceived image appear substantially unchanged to an on-axis viewer.

A fifth aspect of the present invention provides a multi-primary display panel adapted to receive pixel data constituting an image, the pixel data including at least four sub-pixel colour components having respective data values; and modify one or more of the sub-pixel colour component data values;

wherein the display panel is adapted to modify the data values of corresponding sub-pixels from a pair of pixels in opposite directions to one another and such that the overall luminance of the display panel and the perceived image appear substantially unchanged to an on-axis viewer of the display panel.

A sixth aspect of the present invention provides a multi-primary display panel adapted to receive pixel data constituting an image, the pixel data including at least four sub-pixel colour components having respective data values; and modify one or more of the sub-pixel colour component data values;

wherein the display panel is adapted to modify data values for the primary sub-pixels of a pixel and for the non-primary sub-pixel(s) of the pixel such that the overall change in luminance of the primary sub-pixels is approximately equal and opposite to the overall change in luminance of the non-primary sub-pixel(s) whereby the overall luminance of the pixel and the perceived image appear substantially unchanged to an on-axis viewer.

A first aspect of the present invention provides a computer-readable medium containing instructions which, when executed by a processor, cause the processor to perform a method of the invention.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

FIG. 6(*a*) shows a one pixel by one pixel black and grey chequer board and FIG. 6(*b*) shows the appearance of FIG. 6(*a*) when the halftoning pattern of FIG. 5 is applied.

FIG. 9(*b*) shows a modification pattern that can be applied to the array of pixels illustrated in FIG. 9(*a*).

FIGS. 10(*b*) and 10(*c*) show modification patterns that can be applied to the array of pixels illustrated in FIG. 10(*a*).

FIG. 11(*b*) shows a modification pattern that can be applied to the array of pixels illustrated in FIG. 11(*a*).

FIG. 12(*b*) shows a modification pattern that can be applied to the array of pixels illustrated in FIG. 12(*a*).

FIGS. 13(*b*) and 13(*c*) show modification patterns that can be applied to the array of pixels illustrated in FIG. 13(*a*).

FIG. 14(*b*) shows a modification pattern that can be applied to the array of pixels illustrated in FIG. 14(*a*).

FIG. 31: Illustrates another method for preventing colour artefacts whilst still achieving improvements in the off-axis images.

DESCRIPTION OF THE EMBODIMENTS

Figure 1:
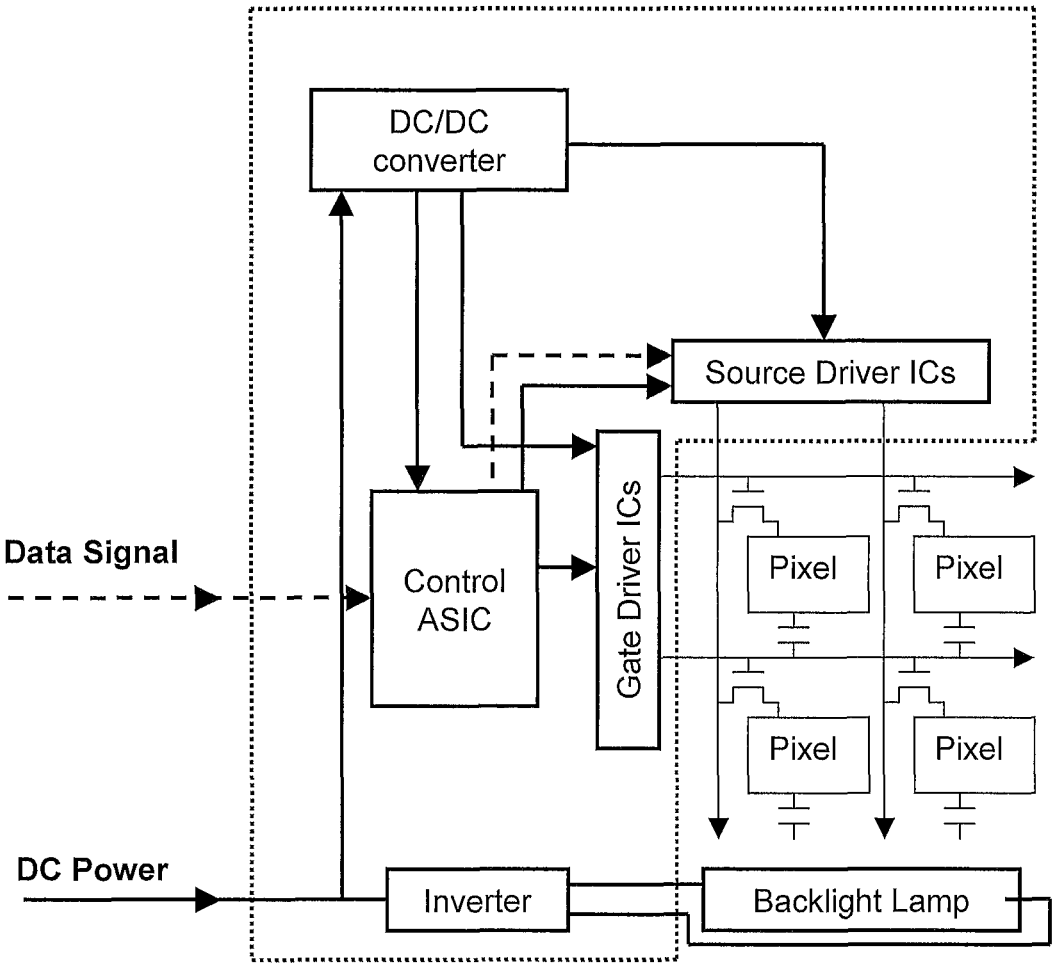
FIG. 1: Is a schematic of the standard layout of the control electronics for an LCD.
Figure 2:
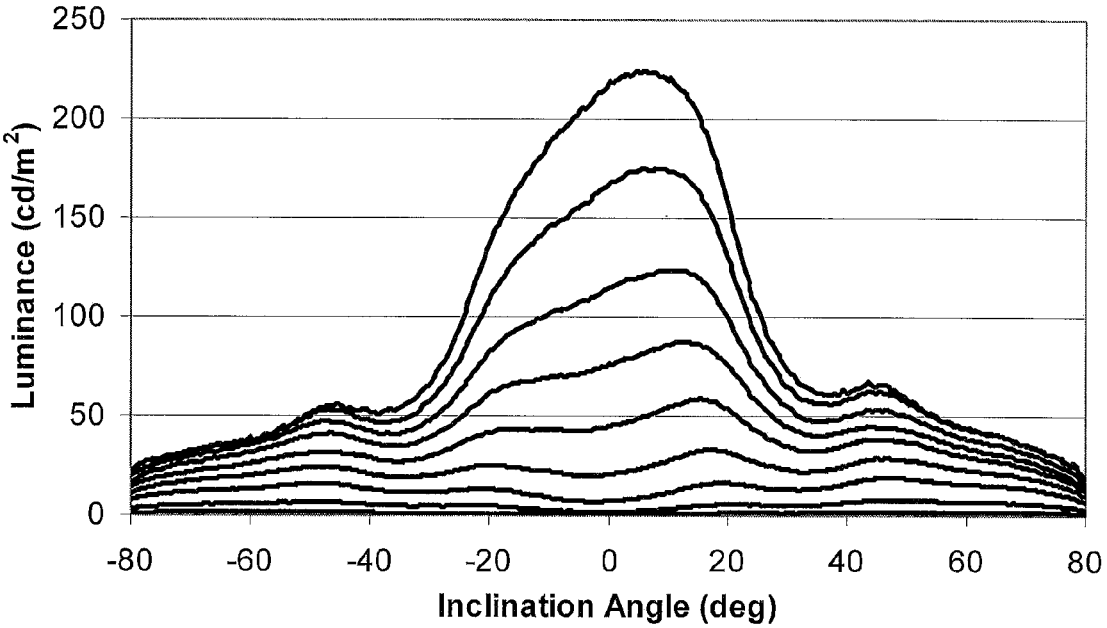
FIG. 2: Is a graph showing the measured angular luminance dependency of a VAN mode LCD at a range of input data levels.
Figure 3:
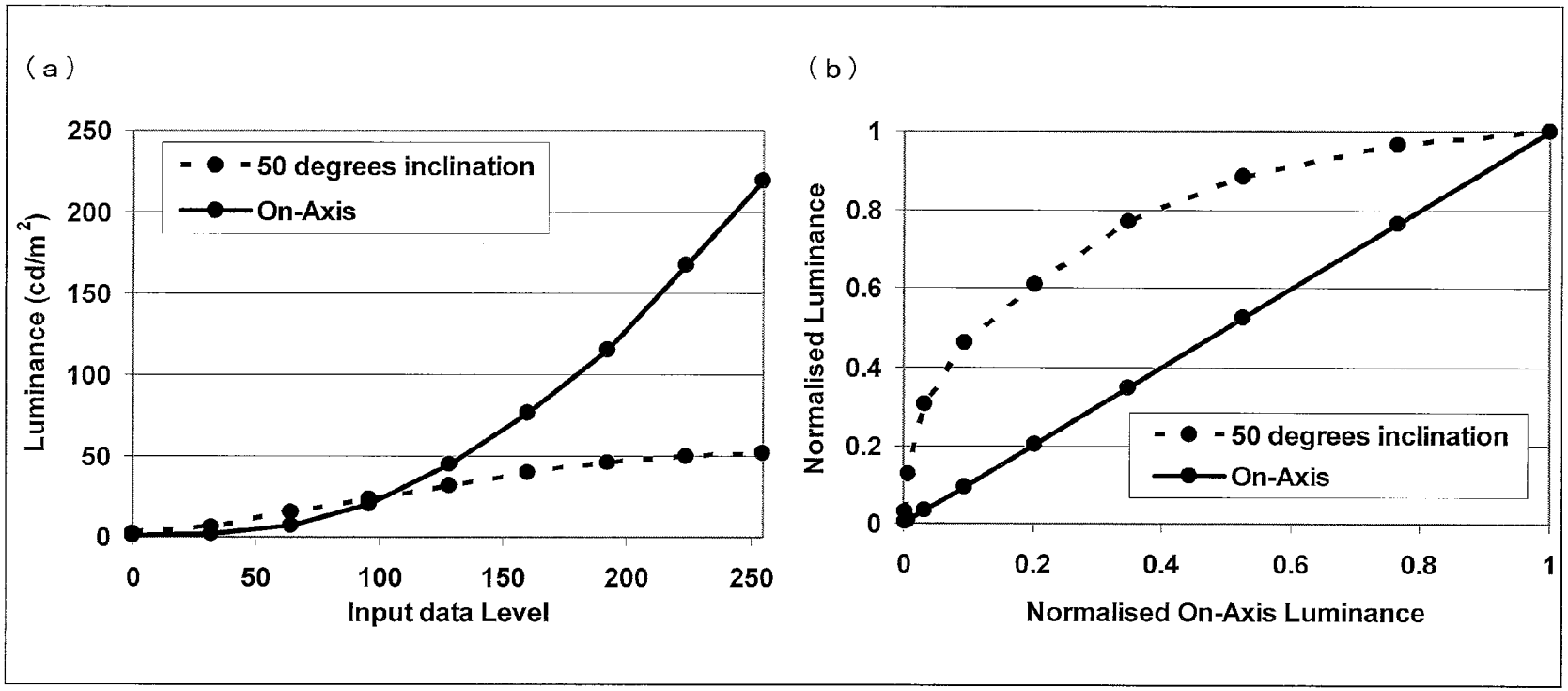
FIG. 3: (a) and (b) are a pair of graphs showing the data for FIG. 2 at 0° and 50° viewing inclination as a function of input data level and luminance at 0° viewing inclination.
Figure 4:
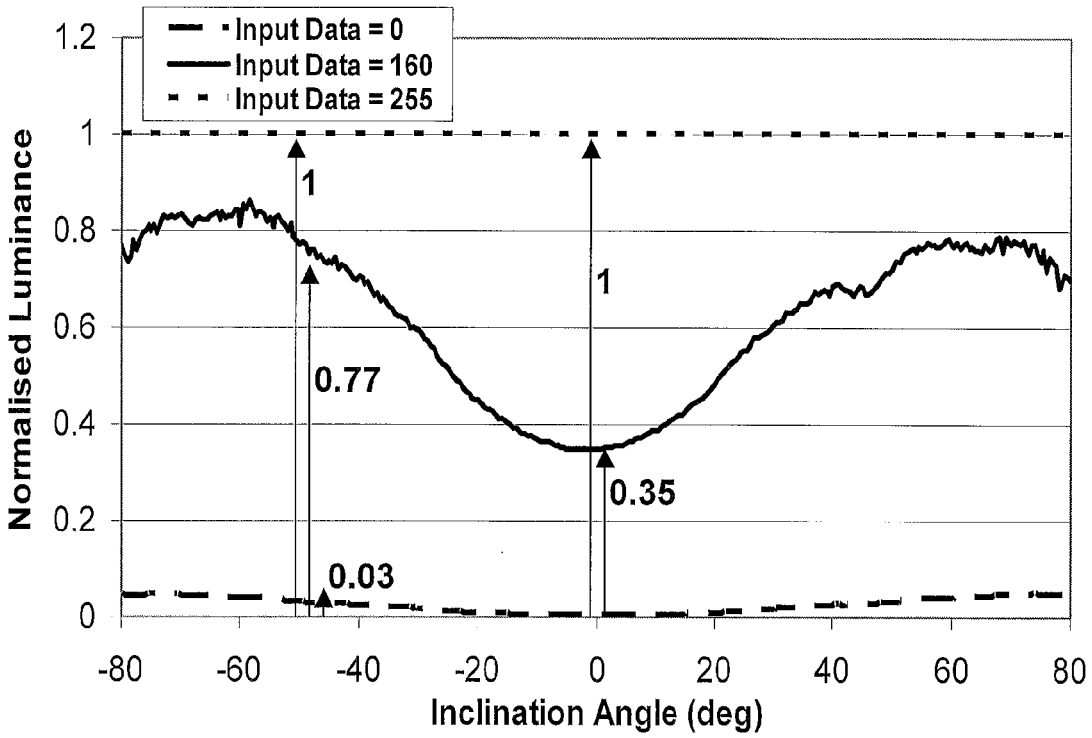
FIG. 4: Is a graph showing the measured angular luminance dependency of a VAN mode LCD at a range of input data levels, normalised to the luminance of the maximum input data level at each angle.
Figure 5:
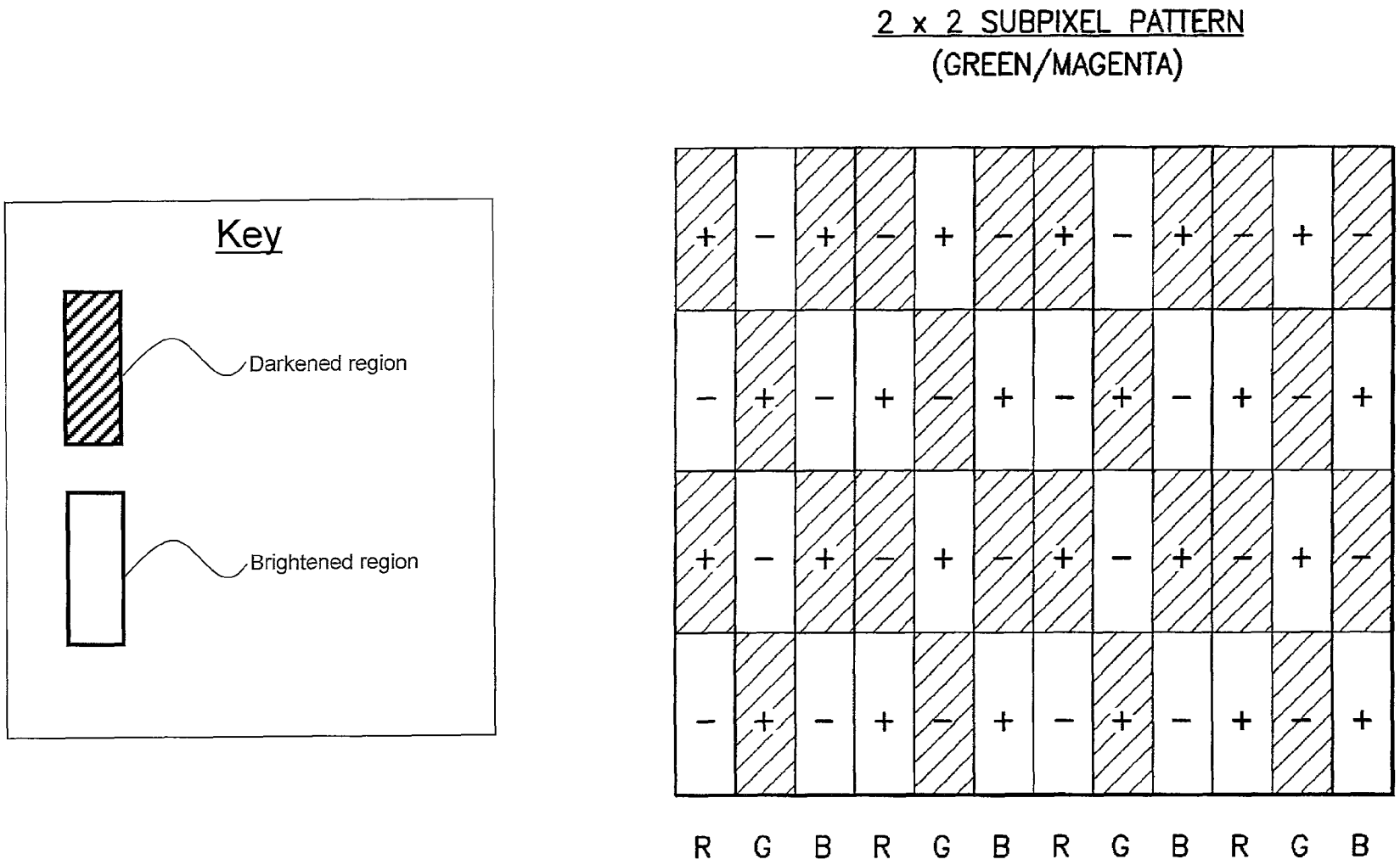
FIG. 5: Is an illustration of a 2×2 RGB sub-pixel pattern with a green/magenta arrangement.
Figure 6:
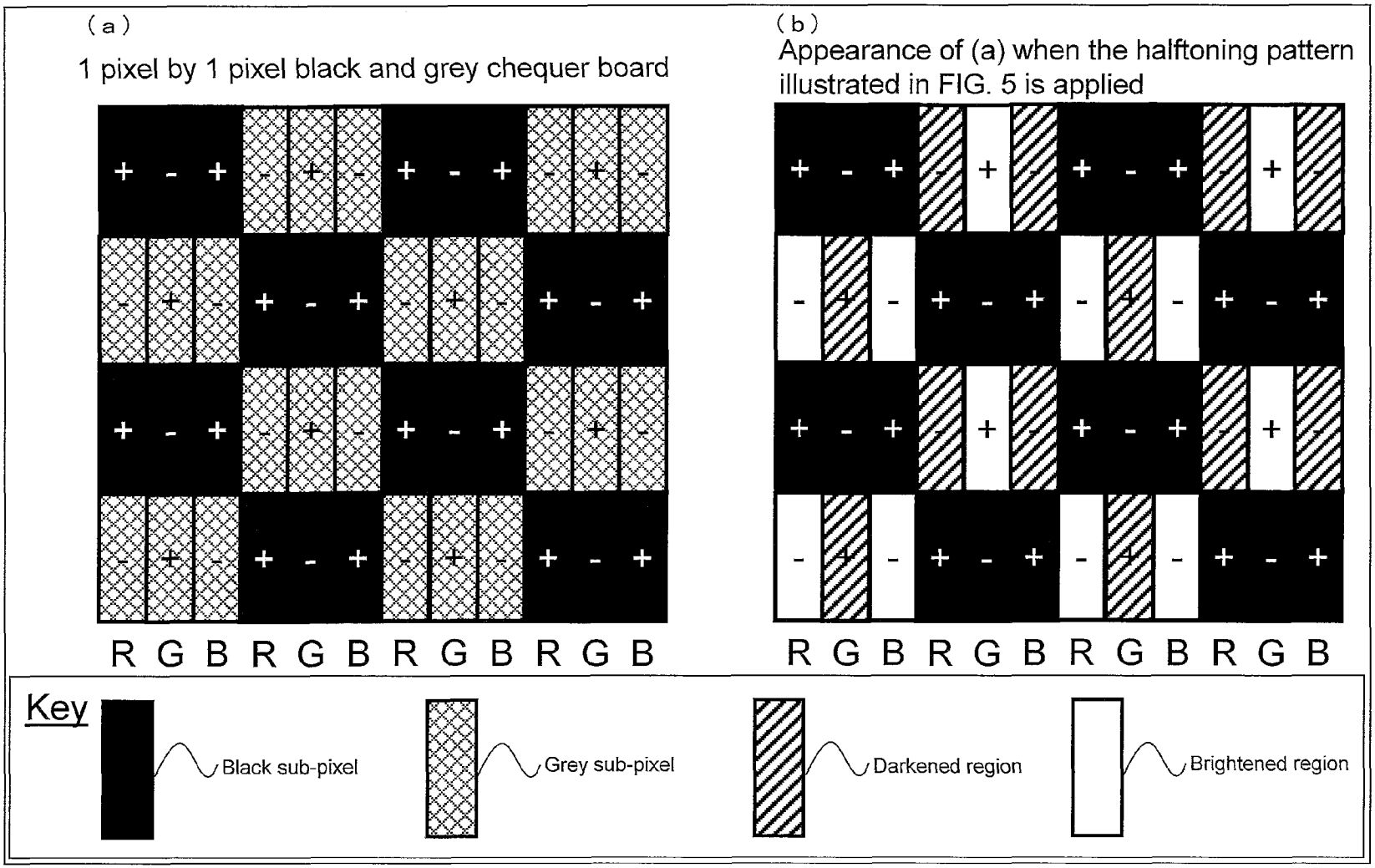
FIGS. 6: (a) and 6(*b*) demonstrate the appearance of coloured artefacts when the halftoning pattern illustrated in FIG. 5 is disrupted.

In an exemplary embodiment of a display in accordance with the present invention, the display includes a standard LCD display, an example of which is illustrated in FIG. 1, with modified control electronics.

When such a display is operating in a standard manner, a set of main image data constituting a single image is input to the control electronics in each frame period, typically in the form of a serial bit stream. The control electronics then outputs a set of signal data voltages to the LC panel. Each of the signal voltages is directed by the active matrix array of the LC panel to the corresponding pixel electrode and the resulting collective electro-optical response of the pixel in LC layer generates the image.

As described above, in displays including a colour shift reduction technology, the image data can be modified in the control electronics, the driver circuitry, or the in-pixel electronics so that pairs of pixels or identical pairs of sub-pixels from two pixels have their data values modified in opposite directions. This has the effect of transferring luminance either from one pixel to another or from one sub-pixel to another. Luminance is transferred in such a way so as to ensure the combined luminance of a pixel pair observed by an on-axis viewer appears unchanged (so that the overall luminance and perceived image of the display panel appear substantially unchanged to an on-axis viewer of the display panel) and the appearance observed by an off-axis viewer appears improved. As noted, the two pixels may be two pixels in a frame that are spatially close to one another so that the eye of an observer can average the luminance of the two pixels, or the two pixels may have the same spatial position as one another but occur in two different, but consecutive, frames, or the two pixels may have the same spatial position as one another but occur in first and second different, but consecutive, groups of frames.

Referring to FIG. 1 according to an exemplary embodiment of the invention, the control ASIC is modified to carry out the process described herein in accordance with the present invention, in addition to otherwise conventional control. The control ASIC includes an input for receiving the display input data in the form of a plurality of pixel data constituting an image. Each of the pixel data includes a plurality of sub-pixel colour components having respective data values. The control ASIC includes a modifying section which modifies the sub-pixel colour component data values, included in the pixel data, as described further herein to reduce colour shift when displayed on the LCD. The modified pixel data is in turn provided to the LCD display.

The modified data values output to the display are stored in look-up tables (LUTs), one for each coloured sub-pixel. Each of the LUTs include two columns, each with as many rows as there are input data levels, for example 256 in an 8 bit per colour display. If desired the LUTs may be combined into a single expanded LUT with a greater number of columns. Within each LUT, which output value is selected is dependent on a modification pattern based on the position of the pixel or sub-pixel being modified in the image to be displayed. For example, to produce a pattern of darkened and brightened pixels or sub-pixels in a chequerboard arrangement, pixels or sub-pixels with a row and column position which are both odd or both even on the display may be modified to take the higher of the two possible output values in the LUT, while pixels or sub-pixels with a row and column position in the image which are odd and even, or even and odd, respectively, may be modified to take the lower of the two possible output values. The bright-dark pattern of pixels or sub-pixels may be reversed for one or more of the colour components of the image in order to reduce the pixel to pixel luminance change. Indeed, any variant or combination of spatial and/or temporal arrangement of higher and lower adjusted pixel values, which allow the on-axis viewer to observe the image comfortably without apparent degradation, may be employed.

Figure 7:
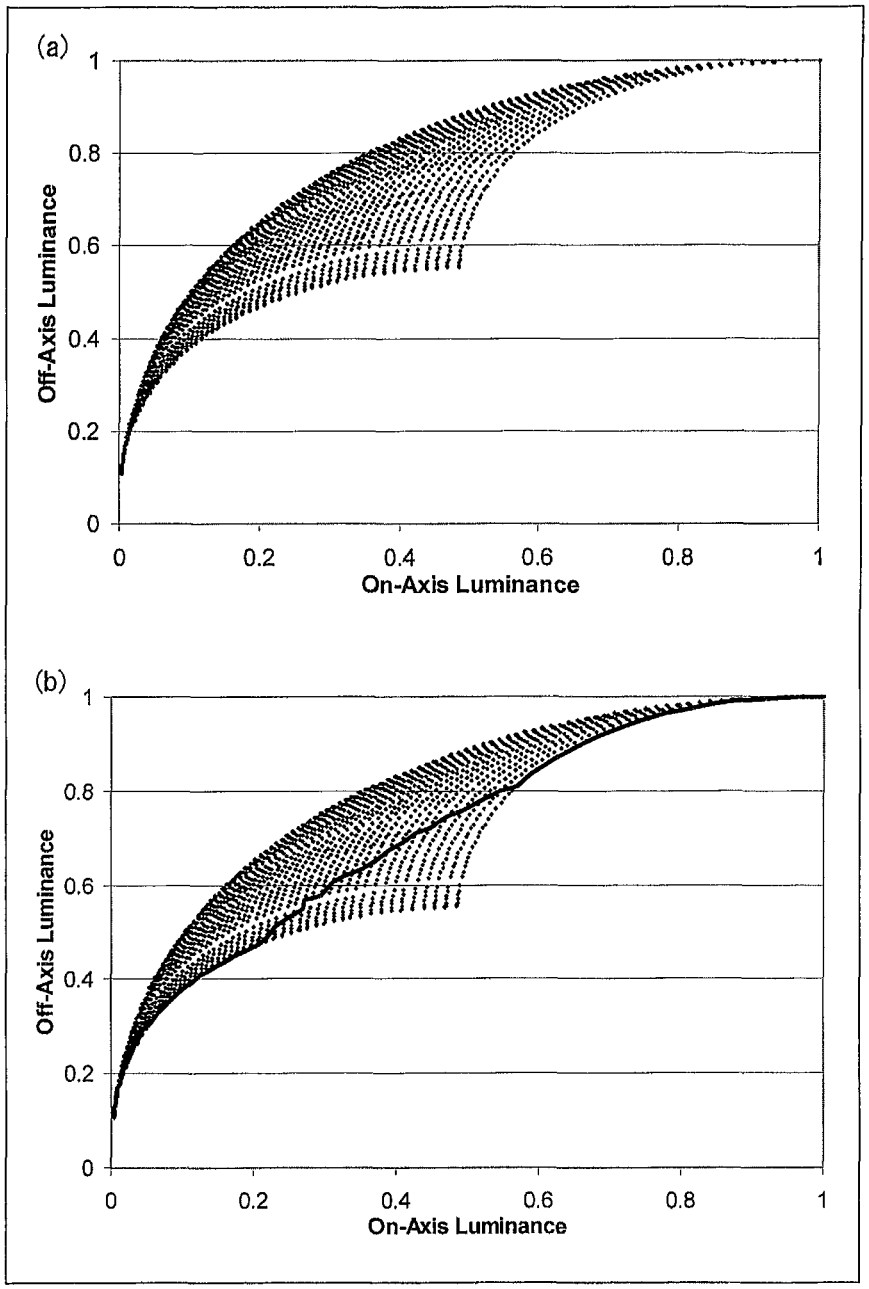
FIG. 7: (a) and (b) are graphs illustrating off-axis luminance to on-axis luminance for all possible combinations of data values for a colour channel.

The values of LUTs may be calculated using the following method. The on-axis and off-axis (e.g. at 50° inclination) luminance of the display may be measured for all input data value, or indeed for a selection of the possible data values and the remainder interpolated, of a particular colour channel. From this data, the average combined off-axis and on-axis luminance for all possible combinations of data values on two pixels of the colour may be inferred. If these values are normalised, and each combination plotted as a point in on-axis to off-axis luminance space, the result is as shown in FIG. 7(*a*).

A series of these points can be selected according to the required on-axis and off-axis luminance for each input data value of the LUT. FIG. 7(*b*) shows that same population for available average on-axis and off-axis luminance points for the pixel data combinations, with a bold black line joining the points which have been selected for the LUT. In this case, the points have been selected to provide a normalised on-axis luminance for each input data value which is as close to the normalised on-axis luminance which the input data value would itself produce, and a normalised off-axis luminance which is as close as possible to the normalised on-axis luminance, which avoiding any sharp changes in off-axis luminance between points with similar on-axis luminance, which would cause image artefacts to the off-axis viewer. Any off-axis to on-axis luminance trace within the space of available points may be selected but traces of the form shown in FIG. 7(*b*) have been shown to provide good colour shift improvement. The output values of the LUT can then be determined as being the combination of two data values which produced each selected point of FIG. 7(*b*). This method may be performed for each colour channel of the display, providing a means to achieve good colour shift improvement with only one LUT required for each colour channel, each LUT consists of a pair of output data values for each input data value.

In the exemplary embodiment, the different LUTs store pairs of output values which are calculated based on the gamma characteristic of the display. The output values chosen ensure that for any given input value each LUT will produce a pair of output pixel with the same average luminance to the on-axis viewer.

In the exemplary embodiment modified data values are applied to pairs of pixels or to identical pairs of sub-pixels from a pair of pixels of a multi-primary display. For example, in an example where the invention is applied using two pixels in a frame that are spatially close to one another, such as two neighbouring pixels, the modified data values could be applied to identical pairs of sub-pixels of neighbouring pixels in a multi-primary display with pixels containing four or more sub-pixels: one red, one green, one blue and one white. The data modification pattern is applied in a chequerboard arrangement where the sub-pixels with a row and column position which are either both odd or both even on the display may be modified to take the higher of the two possible values in the LUT that corresponds to that coloured sub-pixel, while sub-pixels with a row and column position which are odd and even, or even and odd, respectively, may be modified to take the lower of the two possible output values in the LUT that corresponds to that coloured sub-pixel. It must be noted that the multi-primary display is not restricted to this combination of sub-pixels neither is it restricted to 4 sub-pixels.

After the data modification steps have been performed on all pixel data values in the input image, the modified image is output from the modified control electronics to the display. An example process flow diagram for performing the above is given in FIG. 8. The diagram only shows four inputs however it must be noted that the system is not restricted to four. The process flow may be implemented via hardware, software stored in computer-readable memory such as read-only memory, or the like, or a combination of the above may be implemented, for example, in the control ASIC of the control electronics represented in FIG. 1. Those having ordinary skill in the art of computer software and/or hardware design for LCD displays will readily appreciate, based on the description provided herein, how to provide software and/or hardware to carry out the functions described herein without undue effort or experimentation. Accordingly, further detail as to the particular arrangement has been omitted herein for the sake of brevity.

Figure 8:
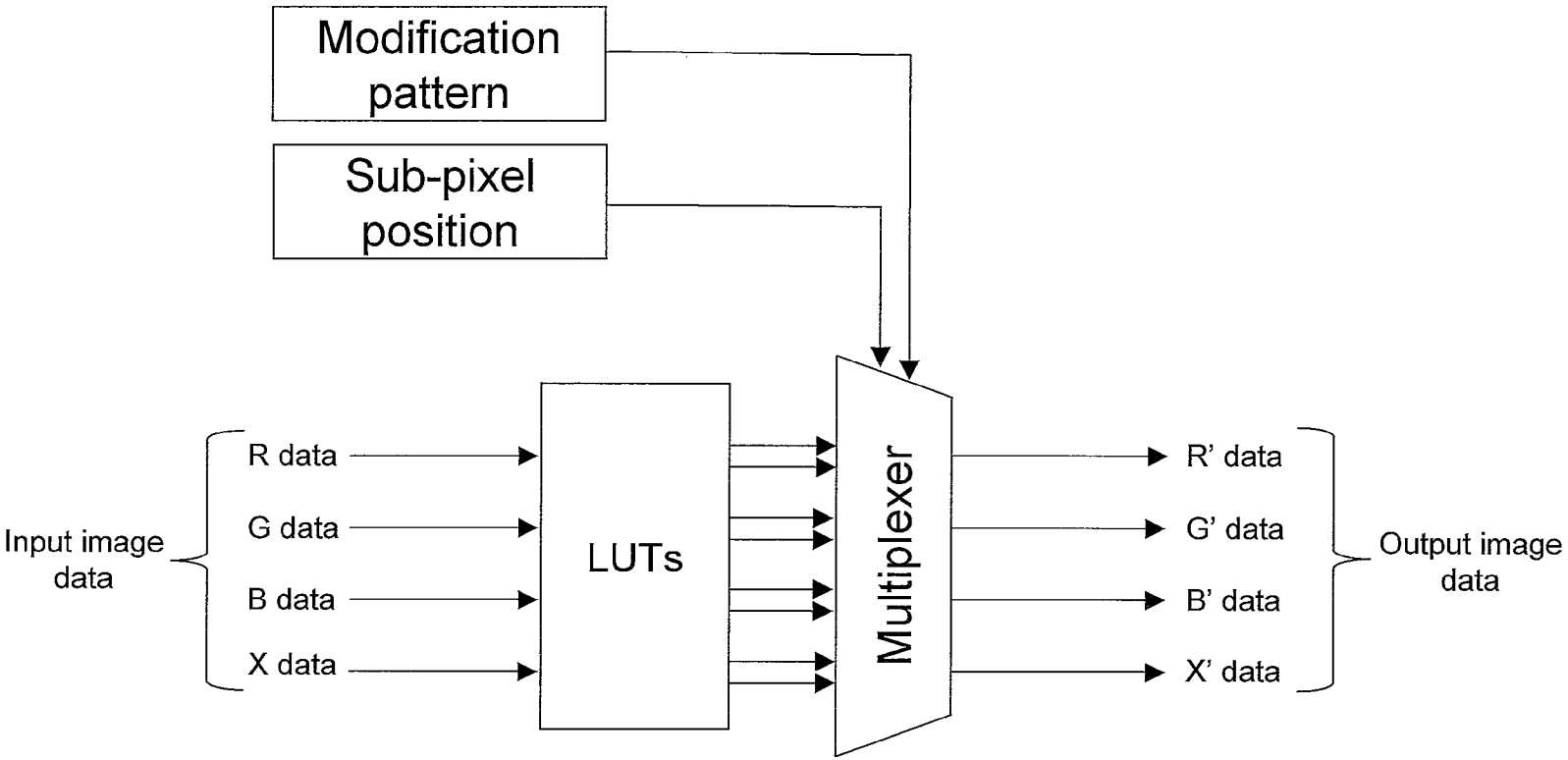
FIG. 8: Is a process flow diagram showing a possible hardware implementation in accordance with an embodiment of the invention.

FIG. 8 exemplifies how initial multi-primary sub-pixel data values, constituting an image, are received by the control ASIC, processed in accordance with the invention, and output as modified sub-pixel data values. In FIG. 8 the input sub-pixel data values are labelled R, G, B and X and the output data values are labelled R', G', B' and X'. The LUTs provide the modified output data values, which are fed to the multiplexer. Within the LUTs, which particular output value is selected is dependent on the modification pattern and sub-pixel position, which are also fed to the multiplexer. The modified image data from the selected output of the selected LUTs is then provided to the source driver ICs and presented to each corresponding pixel.

In further embodiments modified data values are applied to identical pairs of sub-pixels from two pixels of a multi-primary display in such a way so as to minimise the net change in luminance of each pixel of the two pixels. This may be done for a plurality of pixel pairs, for example on a pixel pair-by-pixel pair basis. This is done by selecting one of the at least two modified data values, stored in an LUT, for each sub-pixel so that the change in luminance of one or more of the sub-pixels is approximately equally balanced by the change in luminance of one or more of the remaining sub-pixels. In applying this modification method it is possible to reduce the apparent luminance resolution loss of a multi-primary display compared to a standard RGB display. For the specific case of a multi-primary display with one red, one green, one blue and white sub-pixel, the optimum modification pattern that on average gives the smallest total net change in luminance for the whole display is when the red, green and blue sub-pixels are modified oppositely to the white sub-pixel. For the specific case of a multi-primary display with one red, one green, one blue and one yellow sub-pixel, the optimum modification pattern that on average gives the smallest total net change in luminance for the whole display is when the red and green sub-pixels are modified oppositely to the blue and yellow sub-pixels.

The net change in luminance, ΔL, is calculated using the following equations:

$$\Delta L = L_{INPUT} - L_{OUTPUT}$$

$$L_{INPUT} = (\mathrm{Weight}_{RED} \cdot R'_{INPUT} + \mathrm{Weight}_{GREEN} \cdot G'_{INPUT} + \mathrm{Weight}_{BLUE} \cdot B'_{INPUT} + \mathrm{Weight}_{X} \cdot X'_{INPUT})$$

$$L_{OUTPUT} = (\mathrm{Weight}_{RED} \cdot R'_{OUTPUT} + \mathrm{Weight}_{GREEN} \cdot G'_{OUTPUT} + \mathrm{Weight}_{BLUE} \cdot B'_{OUTPUT} + \mathrm{Weight}_{X}' \cdot X'_{OUTPUT})$$

Where $\mathrm{Weight}_{RED}$, $\mathrm{Weight}_{GREEN}$, $\mathrm{Weight}_{BLUE}$ and $\mathrm{Weight}_{X}$ are the weightings of the red, green, blue and X sub-pixels respectively. $R'_{INPUT}$, $G'_{INPUT}$, $B'_{INPUT}$ and $X'_{INPUT}$ are the gamma adjusted input data values of the red, green, blue and X sub-pixels respectively and $R'_{OUTPUT}$, $G'_{OUTPUT}$, $B'_{OUTPUT}$ and $X'_{OUTPUT}$ are the gamma adjusted output data values of the red, green, blue and X sub-pixels respectively. The gamma adjusted data values are calculated using the following equations:

$$R' = \left(\frac{R}{255}\right)^{\gamma_{RED}}$$

$$G' = \left(\frac{G}{255}\right)^{\gamma_{GREEN}}$$

$$B' = \left(\frac{B}{255}\right)^{\gamma_{BLUE}}$$

$$X' = \left(\frac{X}{255}\right)^{\gamma_{X}}$$

Where R, G, B and X are the data values of the red, green, blue and X sub-pixels respectively and $\gamma_{RED}$, $\gamma_{GREEN}$, $\gamma_{BLUE}$ and $\gamma_{X}$ are the gamma values of the red, green, blue and X sub-pixels respectively.

For the specific case of a multi-primary display with one red, one green, one blue and one white sub-pixel, assuming an sRGB gamut panel and assuming the luminance of the white pixel fully on is equal to the total luminance of the red, green and blue sub-pixels fully on, the weightings have the following values:

$$Weight_{RED} = \frac{0.2126}{2},\ Weight_{GREEN} = \frac{0.7152}{2},\ Weight_{BLUE} = \frac{0.0722}{2} \text{ and } Weight_{WHITE} = \frac{1}{2}$$

and the gamma values are as follows: $\gamma_{RED}=2.2$, $\gamma_{GREEN}=2.2$, $\gamma_{BLUE}=2.2$ and $\gamma_{WHITE}=2.2$ (Recommendation ITU-R BT.709-5, Parameter values for the HDTV standards for production and international programme exchange).

For the specific case of a multi-primary display with one red, one green, one blue and one yellow sub-pixel, assuming an sRGB gamut panel and assuming the luminance of the yellow pixel fully on is equal to the total luminance of the red and green sub-pixels fully on, the weightings have the following values:

$$Weight_{RED} = \frac{0.2126}{2},\ Weight_{GREEN} = \frac{0.7152}{2},$$

$$Weight_{BLUE} = \frac{0.0722}{2} \text{ and } Weight_{YELLOW} = \frac{(0.2126 + 0.7152)}{2}$$

and the gamma values are as follows: $\gamma_{RED}$=2.2, $\gamma_{GREEN}$=2.2, $\gamma_{BLUE}$=2.2 and $\gamma_{YELLOW}$=2.2 (Recommendation ITU-R BT.709-5, Parameter values for the HDTV standards for production and international programme exchange).

Figure 9:
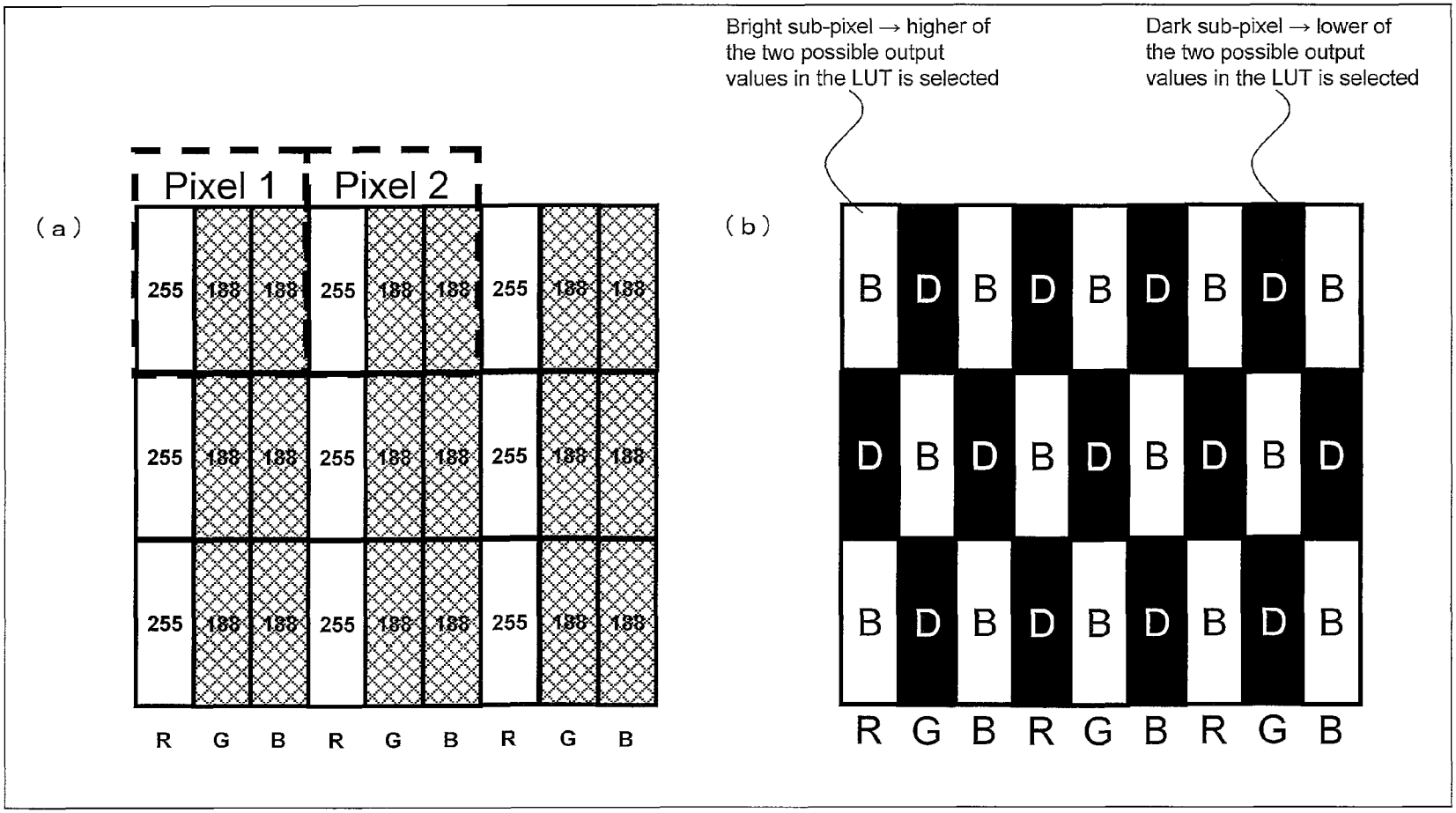
FIG. 9: (a) and (b) illustrate arrays of pixels each of which has one red, one green and one blue sub-pixel.
Figure 10:
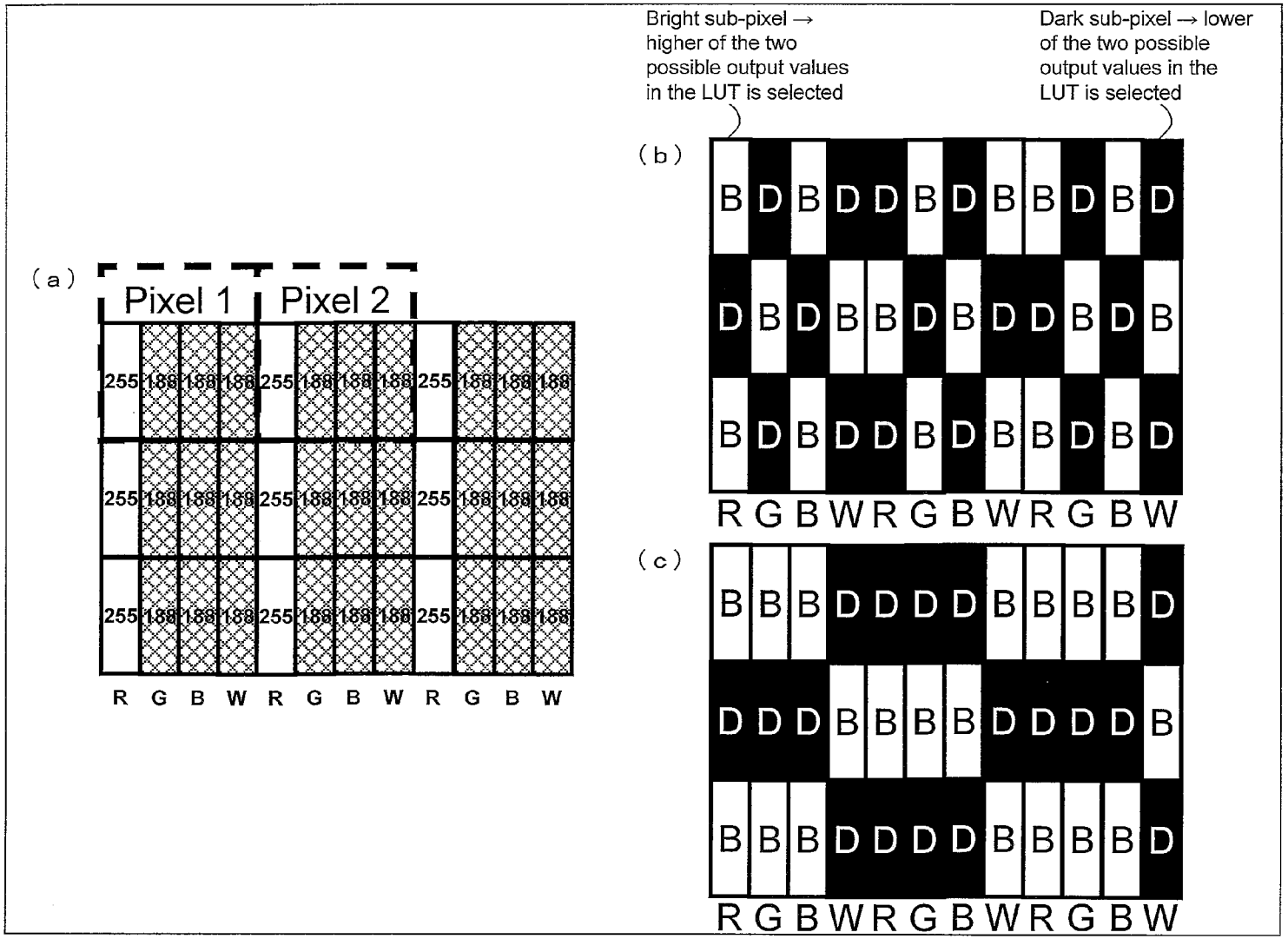
FIG. 10: (a), (b) and (c) illustrate arrays of multi-primary pixels each of which has one red, one green, one blue and one white sub-pixel.

For example, FIG. 9(*a*) illustrates an array of pixels each of which has one red, one green and one blue sub-pixel; the data values of each sub-pixel are shown on the diagram. When the red and blue sub-pixels are modified oppositely to the green sub-pixel, as illustrated by the modification pattern in FIG. 9(*b*), pixel 1 has a 51% net decrease in luminance and pixel 2 has a 51% net increase in luminance. FIG. 10(*a*) illustrates an array of multi-primary pixels each of which has one red, one green, one blue and one white sub-pixel; the data values of each sub-pixel are shown on the diagram. The grey level applied to the red, green and blue sub-pixels in FIG. 10(*a*) is the same as that of FIG. 9(*a*). When luminance is transferred according to the modification pattern illustrated in FIG. 10(*b*), which has a similar modification pattern to that illustrated in FIG. 9(*b*), pixel 1 has a net decrease in luminance of 71% and pixel 2 has a net increase in luminance of 71%. A more optimum modification pattern can be applied to FIG. 10(*a*) where the change in luminance of one or more of the sub-pixels is approximately equal to the change in luminance of one or more of the remaining sub-pixels. To achieve this, the red, green and blue sub-pixels are modified oppositely to the white sub-pixel, as illustrated in FIG. 10(*c*). When the more optimum pattern is applied the net change in luminance of pixel 1 is a decrease of 9% and the net change of pixel 2 is an increase of 9%.

Figure 11:
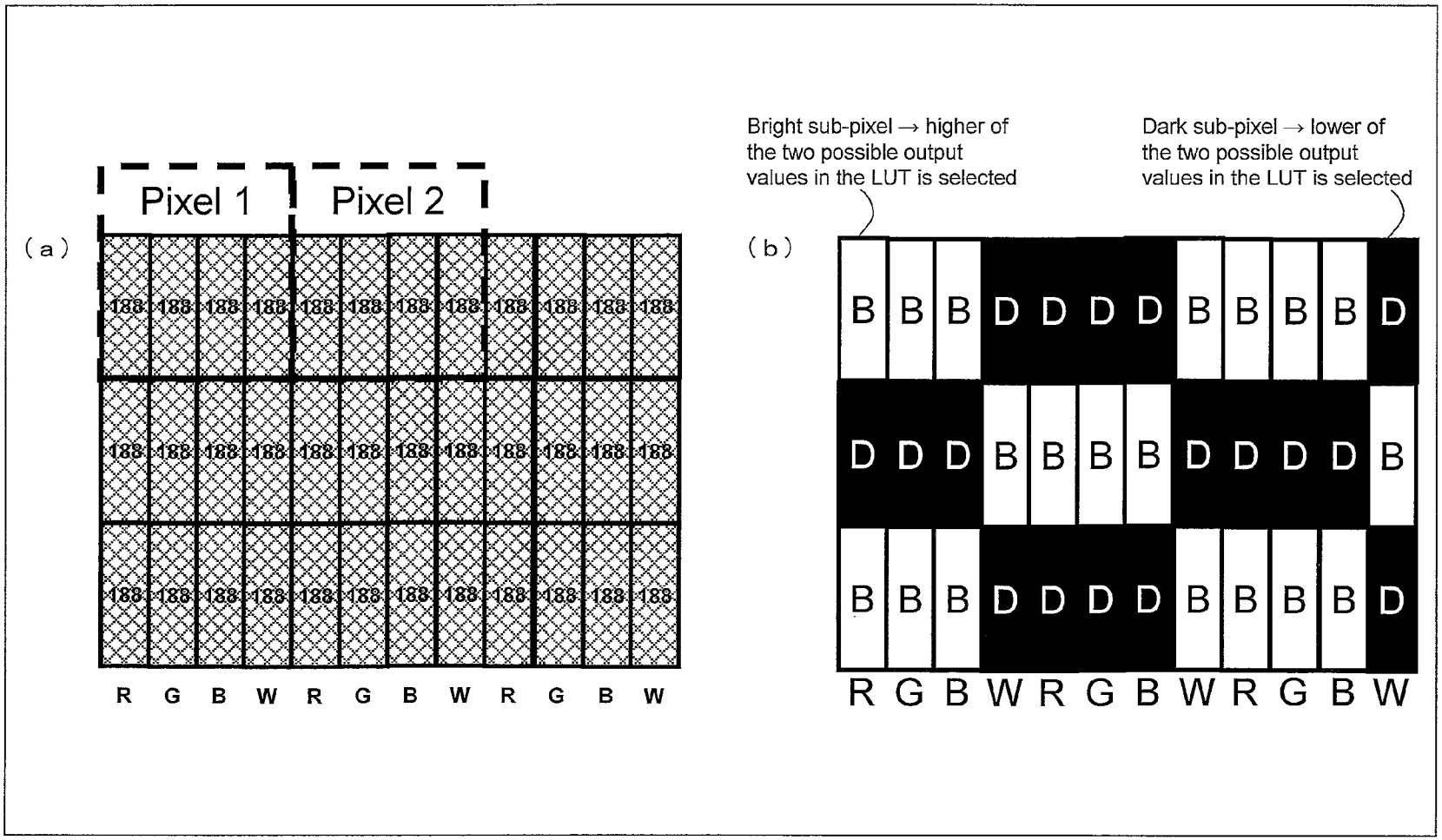
FIG. 11: (a) and (b) illustrate arrays of multi-primary pixels each of which has one red, one green, one blue and one white sub-pixel.

For any pixel showing greyscale data with one red, one green, one blue and one white sub-pixel where the data values of the sub-pixels are all equal, the total luminance of the red, green and blue sub-pixels is equal to the luminance of the white sub-pixel. In other words the total luminance of the sub-pixels that have one type of modification applied is equal to the total luminance of the sub-pixels that have the other type of modification applied. Consequently, the current embodiment has the added advantage that greyscale images, displayed on an RGBW panel with the aforementioned modification pattern, do not suffer from luminance resolution loss as the change in luminance of the red, green and blue sub-pixels is balanced by the change in luminance of the white sub-pixel. Additionally grey scale images do not suffer from chrominance resolution loss and therefore do not suffer from colour artefacts either. For example, FIG. 11(*a*) illustrates an array of pixels showing greyscale data, each of which has one red, one green, one blue and one white sub-pixel; the data values of all the sub-pixels are equal as shown on the diagram. When luminance is transferred according to the modification pattern illustrated in FIG. 11(*b*), which is the same as that in FIG. 10(*c*), the net change in luminance of pixel 1 and pixel 2 is zero.

Whilst coloured images displayed on an RGBW panel do have some luminance resolution loss, this loss is minimised. This is exemplified in the aforementioned example of an array of multi-primary pixels with one red, one green, one blue and one white sub-pixel, illustrated by FIG. 10(*a*), where pixel 1 experiences a net change in luminance of −9% and pixel 2 experiences a net change in luminance of +9% when the modification pattern illustrated in FIG. 10(*c*) is applied. Despite the fact that the net change in luminance of a pixel is non-zero the net change in luminance for a pixel pair is zero, consequently to an on-axis viewer the average luminance of a pixel pair appears unchanged. Coloured images also have some chrominance resolution loss but again the average chrominance (ie the overall chrominance) of a pixel pair is unchanged. If the image content of a coloured image changes sharply from pixel to pixel the image will suffer from coloured artefacts.

Figure 12:
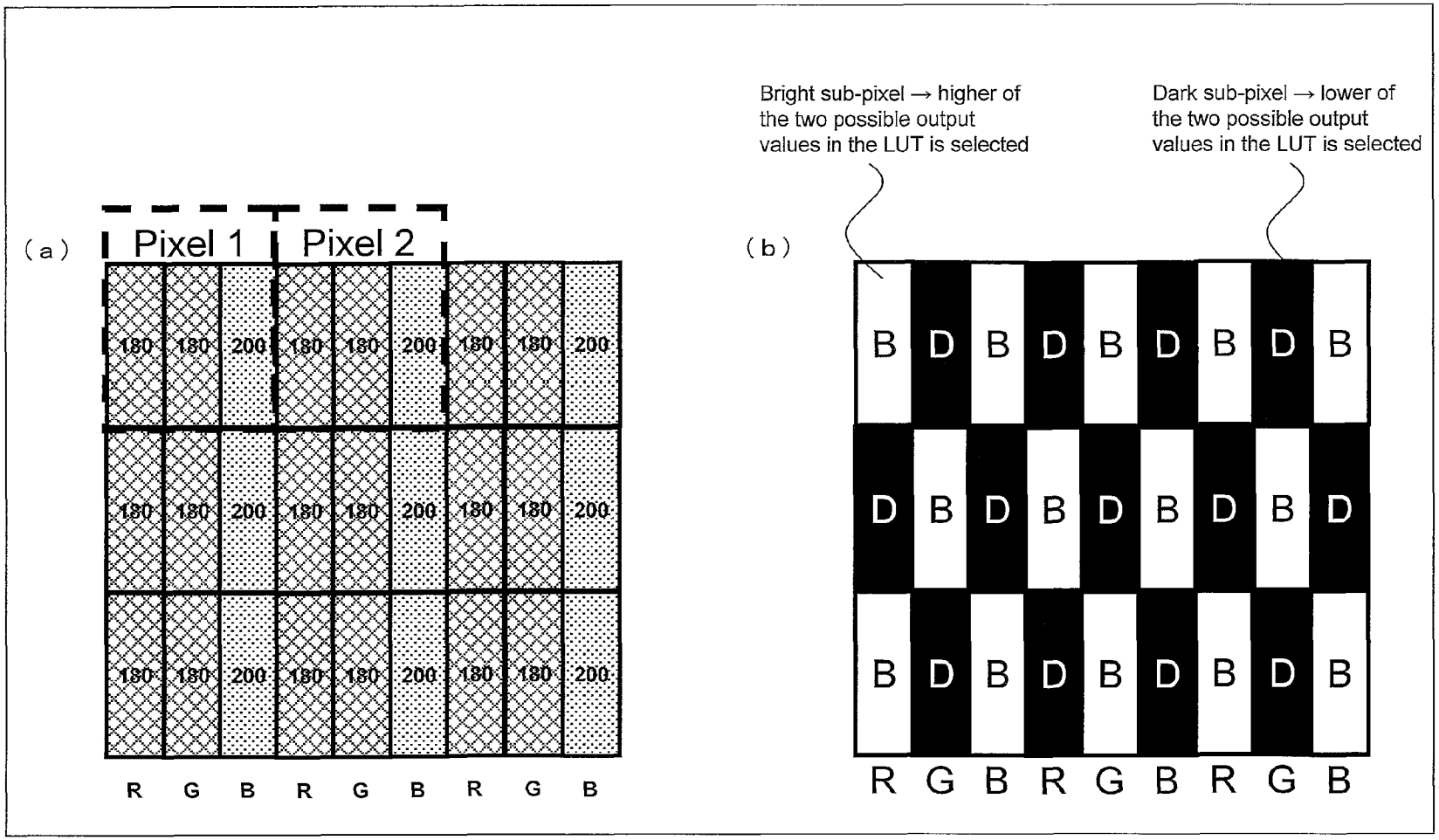
FIG. 12: (a) and (b) illustrate arrays of pixels each of which has one red, one green and one blue sub-pixel.
Figure 13:
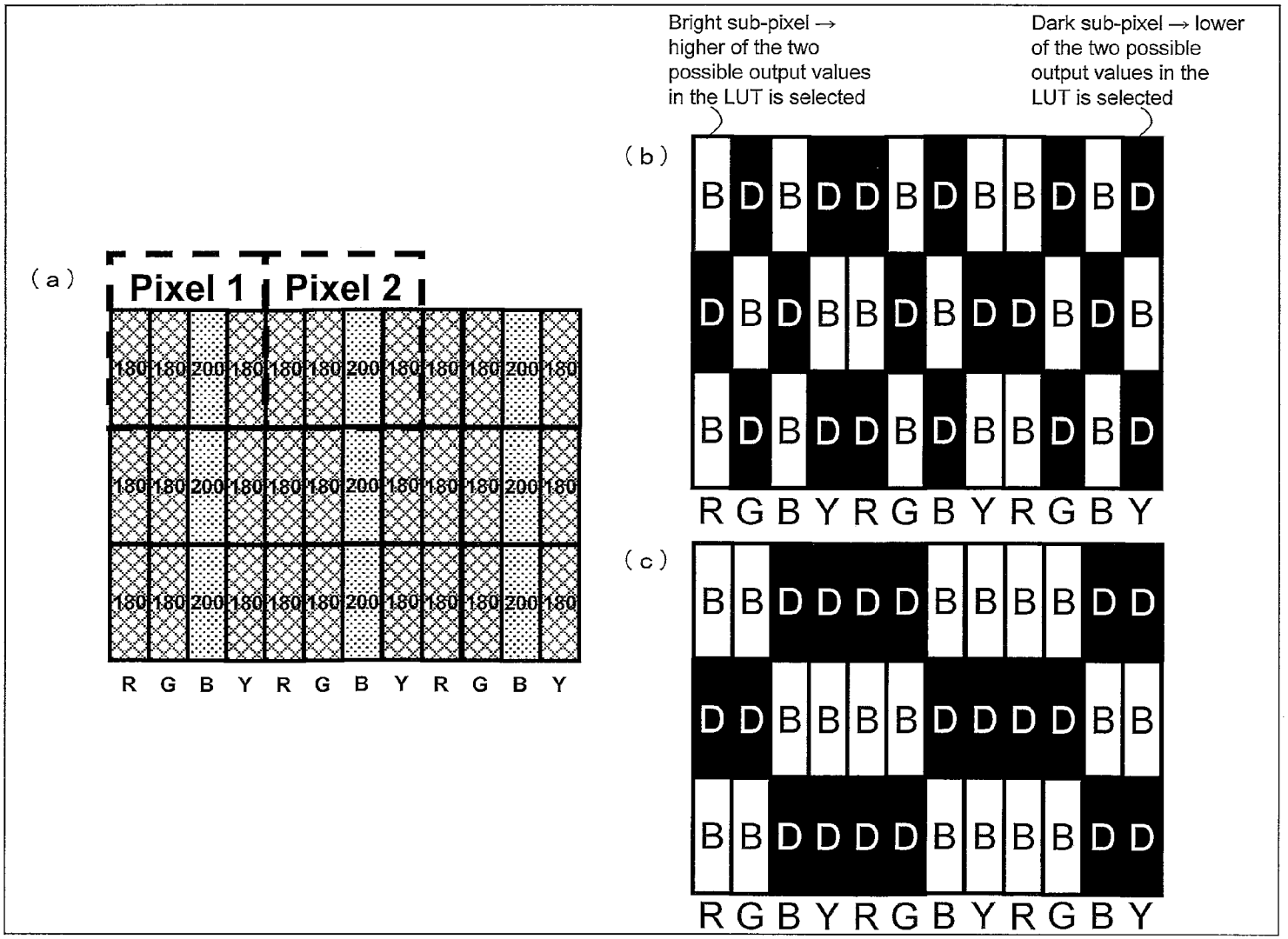
FIG. 13: (a), (b) and (c) illustrate arrays of multi-primary pixels each of which has one red, one green, one blue and one yellow sub-pixel.

In a further example, FIG. 12(*a*) illustrates an array of pixels each of which has one red, one green and one blue sub-pixel; the data values of each sub-pixel are shown on the diagram. When the red and blue sub-pixels are modified oppositely to the green sub-pixel, as illustrated by the modification pattern in FIG. 12(*b*), pixel 1 has a 43% net decrease in luminance and pixel 2 has a 43% net increase in luminance. FIG. 13(*a*) illustrates an array of multi-primary pixels each of which has one red, one green, one blue and one yellow sub-pixel; the data values of each sub-pixel are shown on the diagram. The grey level applied to the red, green and blue sub-pixels in FIG. 13(*a*) is the same as that of FIG. 12(*a*). When luminance is transferred according to the modification pattern illustrated in FIG. 13(*b*), which has a similar modification pattern to that illustrated in FIG. 12(*b*), pixel 1 has net decrease in luminance of 70% and pixel 2 has a net increase in luminance of 70%. A more optimum modification pattern can be applied to FIG. 12(*a*) where the change in luminance of one or more of the sub-pixels is approximately equal to the change in luminance of one or more of the remaining sub-pixels. To achieve this, the red and green sub-pixels are modified oppositely to the blue and yellow sub-pixels, as illustrated in FIG. 13(*c*). When the more optimum pattern is applied the net change in luminance of pixel 1 is a decrease of 3% and the net change in luminance of pixel 2 is an increase of 3%.

Figure 14:
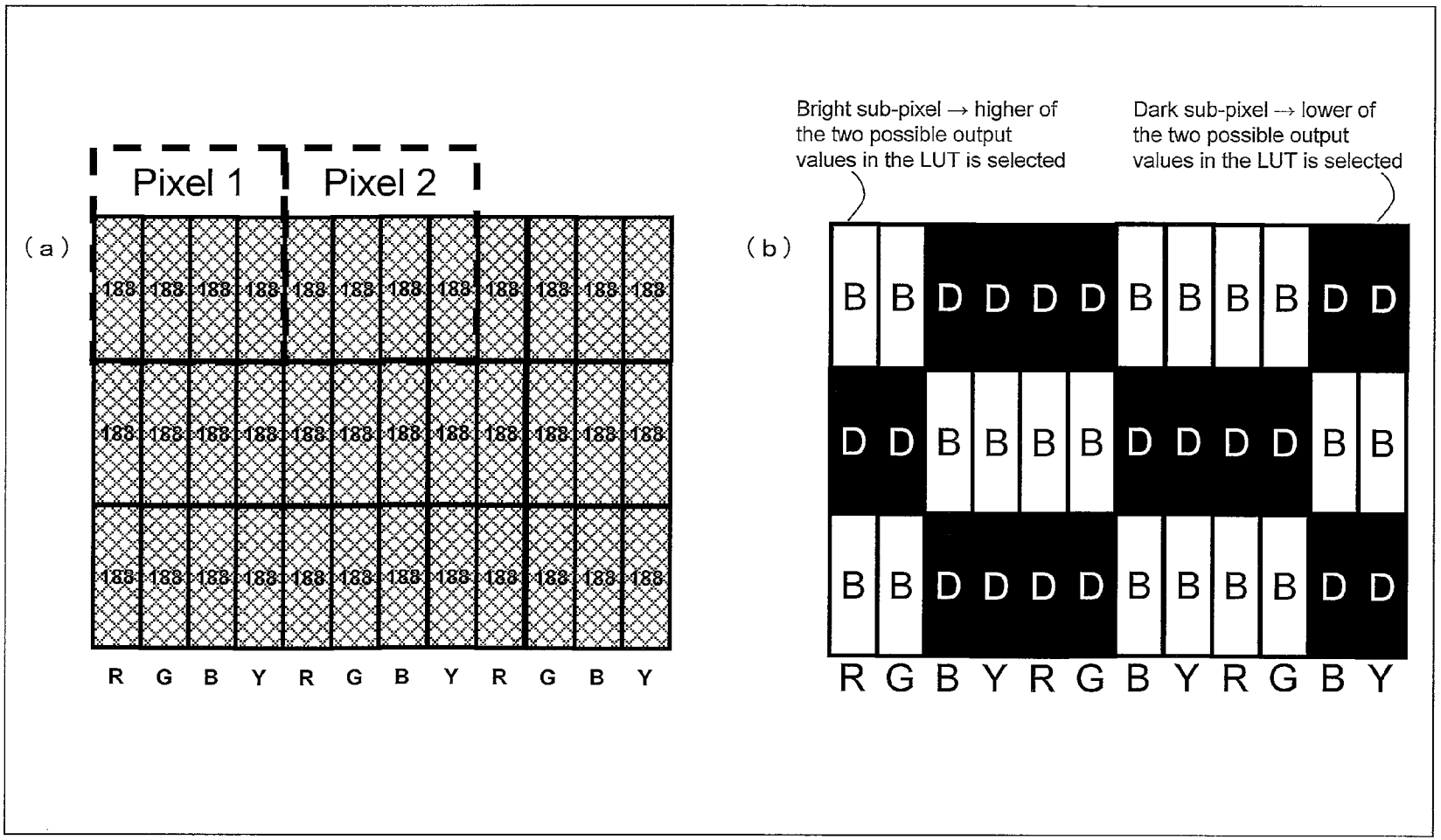
FIG. 14: (a) and (b) illustrate arrays of multi-primary pixels each of which has one red, one green, one blue and one yellow sub-pixel.

For any pixel showing greyscale data with one red, one green, one blue and one yellow sub-pixel where the data values of the sub-pixels are all equal, the total luminance of the sub-pixels that have one type of modification applied is not equal to the total luminance of the sub-pixels that have the other type of modification applied. Consequently, greyscale images, displayed on an RGBY panel with the aforementioned modification pattern, do have some small luminance and chrominance resolution loss, however this resolution loss is still less than that of an RGB panel. For example, FIG. 14(*a*) illustrates an array of pixels showing greyscale data, each of which has on red, one green, one blue and one yellow sub-pixel; the data values of all the sub-pixels are equal as shown on the diagram. When luminance is transferred according to the modification pattern illustrated in FIG. 14(*b*), which is the same as FIG. 13(*c*), the net change of pixel 1 is −4% and the net change in luminance of pixel 2 is +4%. Similarly coloured images also suffer from some small luminance and chrominance resolution loss as demonstrated in the example illustrated by FIGS. 12(*a*) and 12(*c*). However for both greyscale and coloured images the loss in luminance resolution has been minimised through the application of the modification pattern described above. The net change in luminance and chrominance for any pixel pair is zero. Consequently to an on-axis viewer the average luminance and chrominance of a pixel pair appears unchanged. However if the image content of either a greyscale or coloured image, displayed on an RGBY panel, changes sharply from pixel to pixel the image will suffer from coloured artefacts.

In still further embodiments the net change in luminance of a modified image displayed on a multi-primary display can be minimised further by optimising the modification pattern for each pixel pair in the image rather than applying the same modification pattern to all pixel pairs in the image. In the previous embodiment a modification pattern was chosen so that on average, for the whole display, the net change in luminance of the modified pixels was minimised. However, in this embodiment the optimum modification pattern is calculated on a pixel pair, by pixel pair basis.

Figure 15:
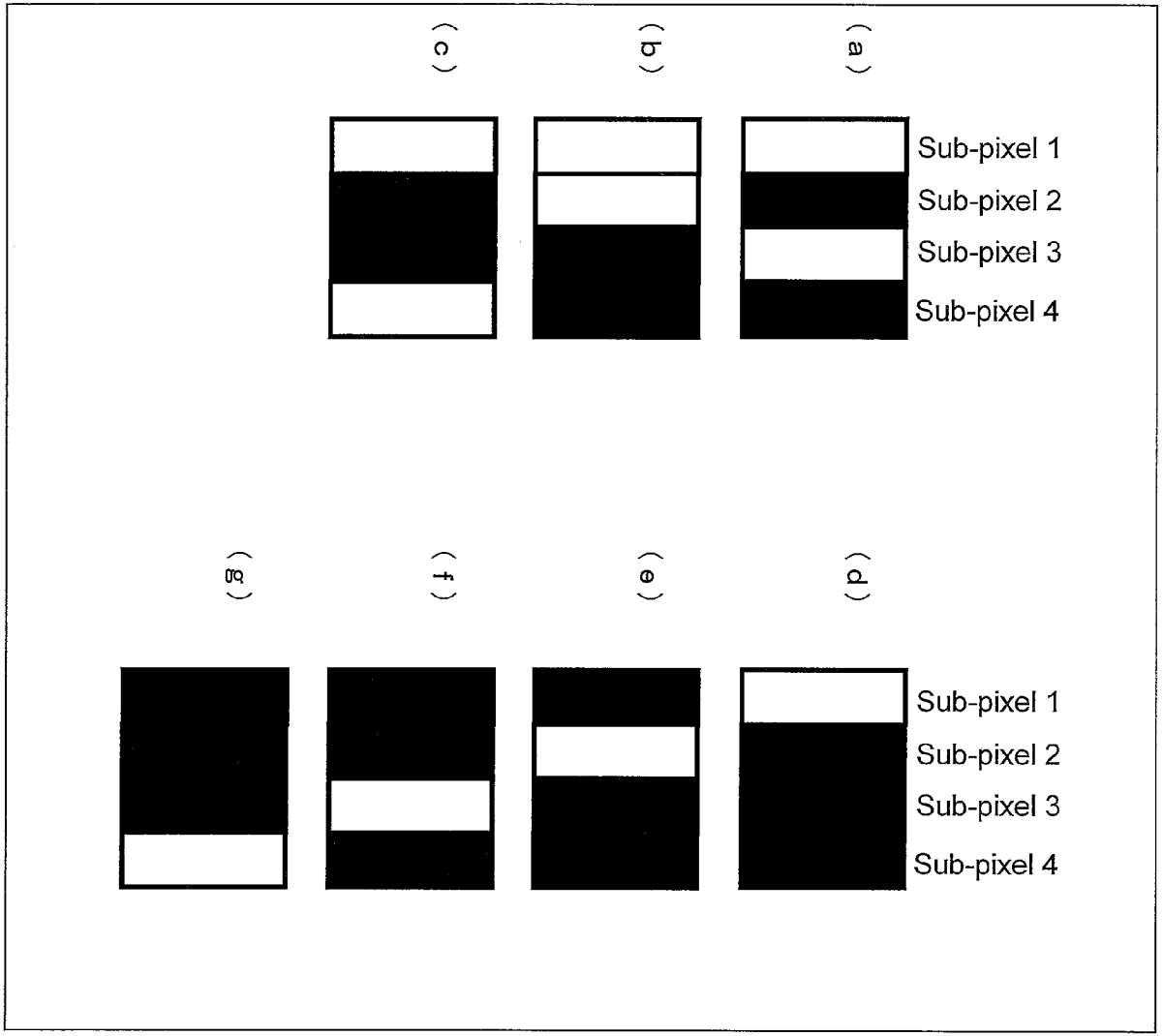
FIG. 15: (a)-(g) illustrate 7 different modification patterns that can be applied to four primary displays.

For the case of a four primary display it is possible to apply 7 different modification patterns (assuming that all sub-pixels are modified; further modification patterns exist if one or more of the sub-pixels is not modified). The seven different patterns are illustrated in FIG. 15(*a*)-(*g*). The 7 patterns are as follows:

(a) Sub-pixels 1 and 3 are modified oppositely to sub-pixels 2 and 4

(b) Sub-pixels 1 and 2 are modified oppositely to sub-pixels 3 and 4

(c) Sub-pixels 1 and 4 are modified oppositely to sub-pixels 2 and 3

(d) Sub-pixel 1 is modified oppositely to sub-pixels 2, 3 and 4

(e) Sub-pixel 2 is modified oppositely to sub-pixels 1, 3 and 4

(f) Sub-pixel 3 is modified oppositely to sub-pixels 1, 2 and 4

(g) Sub-pixel 4 is modified oppositely to sub-pixels 1, 2 and 3

The optimum net change in luminance on a pixel pair, by pixel pair basis, can be determined by calculating the net change in luminance for all possible modification patterns and identifying the pattern that gives the smallest net change in luminance.

In the case of a multi-primary panel with four sub-pixels 7 different calculations of the net change in luminance are made, one for each modification pattern. The modification pattern that results in the smallest absolute net change in luminance is then applied to the pixel pair.

The optimum net change in luminance on a pixel pair, by pixel pair basis, can also be determined by following a predetermined set of rules that identify the pattern that gives the smallest net change in luminance.

Figure 16:
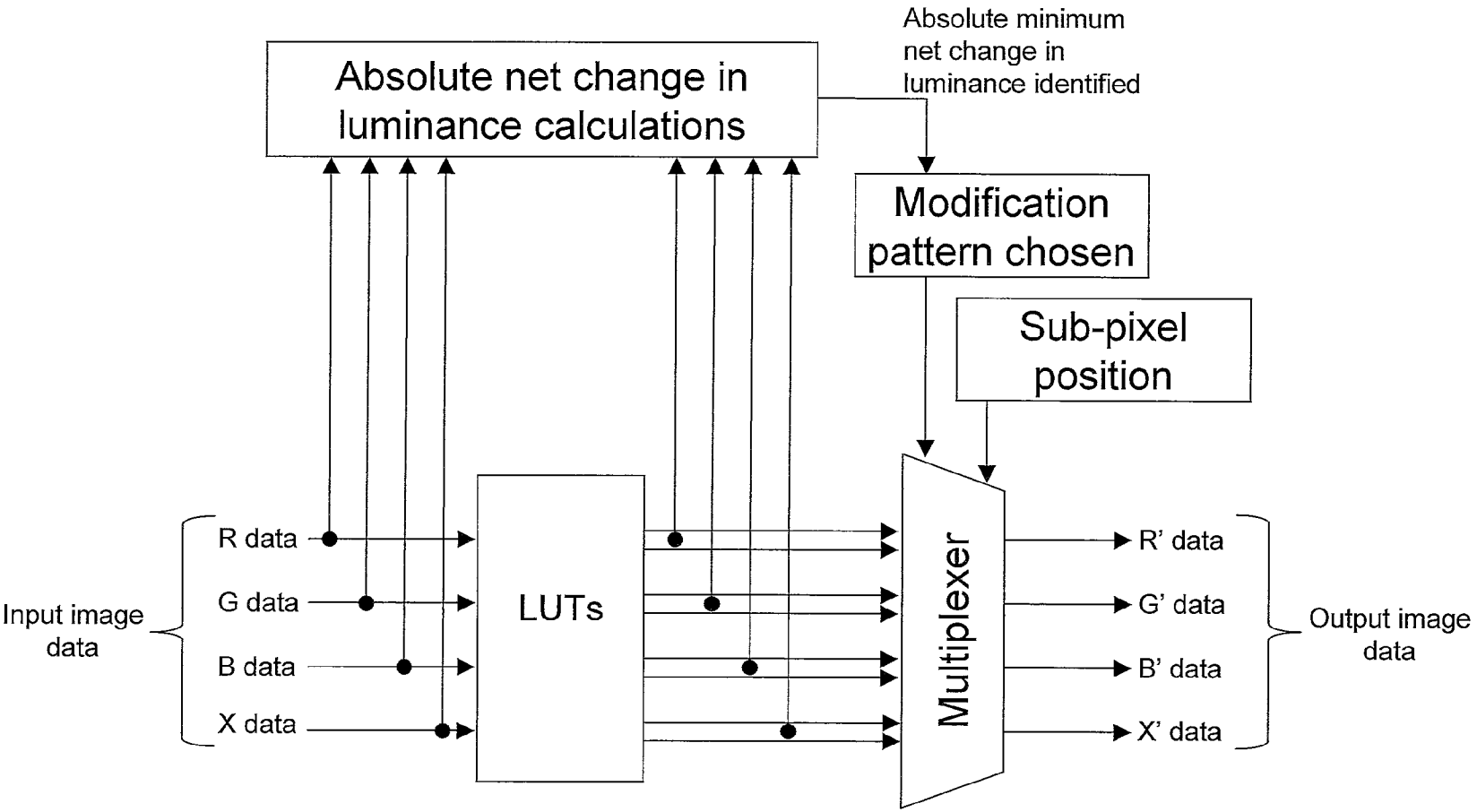
FIG. 16: Is a process flow diagram showing a possible hardware implementation in accordance with an embodiment of the invention.

The process flow of the current embodiment requires additional steps compared to that of the exemplary embodiment. FIG. 16 illustrates the process flow for the current embodiment. The diagram only shows four inputs however it must be noted that the system is not restricted to four.

Figure 17:
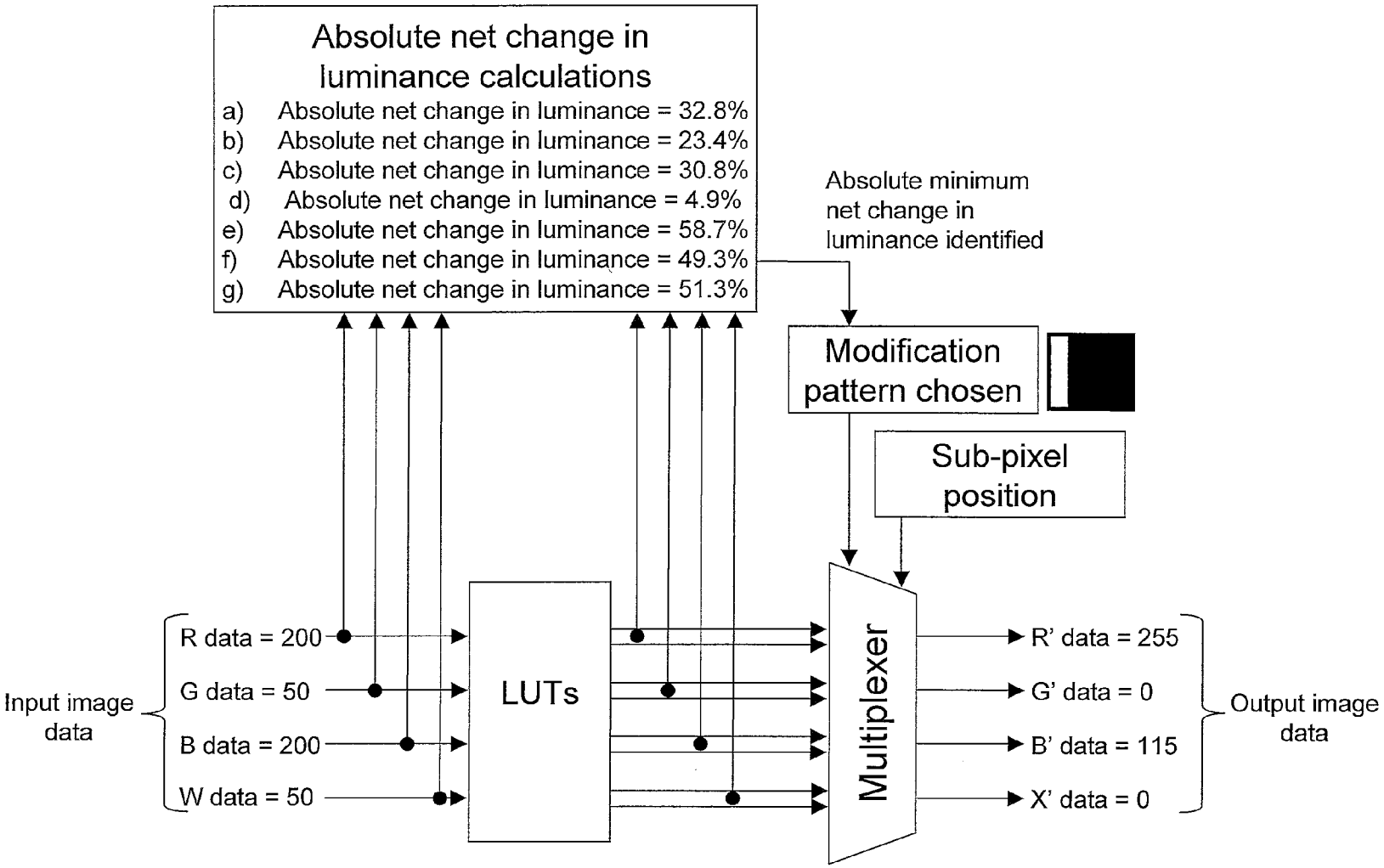
FIG. 17: Illustrates the process flow illustrated in FIG. 16 for the specific case of an input pixel with one red, one green, one blue and one white sub-pixel with data values equal to 200, 100, 200 and 100 respectively.

For example FIG. 17(*a*) illustrates the process flow for the specific case of an input pixel with one red, one green, one blue and one white sub-pixel with data values equal to 200, 50, 200 and 50 respectively. The absolute net change in luminance is then calculated for each of the modification patterns illustrated in FIGS. 15(*a*)-(*g*). These calculations reveal that the pattern that gives the smallest absolute net change in luminance is the pattern illustrated in FIG. 15(*d*). This modification pattern differs from the modification pattern used in the previous embodiment illustrated in FIG. 11(*b*).

The current embodiment has the added advantage when compared to the previous embodiment that the net change in luminance for the whole display is often smaller for the current embodiment. However, the current embodiment does require extra processing steps and consequently greater computing resource is required.

A change in modification pattern from pixel pair to pixel pair may generate visible artefacts to both the on-axis and off-axis viewer. It may be possible to reduce or eliminate these artefacts by keeping the modification pattern of the sub-pixels with the highest luminance contribution fixed and only optimising the modification pattern on a pixel pair by pixel pair basis for the remaining sub-pixels. For example, in a further embodiment, for a display with red, green, blue and white sub-pixels the modifications patterns of the green and white sub-pixels could be fixed (as these are likely to have the highest luminance contribution) and the modification patterns of the red and blue sub-pixels could be optimised to minimise the net change in luminance of the pixel. In the case of a display with red, green, blue and yellow sub-pixels the modifications patterns of the green and yellow sub-pixels could be fixed and the modification patterns of the red and blue sub-pixels could be optimised to minimise the net change in luminance of the pixel.

Whilst the two aforementioned embodiments minimise the effective loss in luminance resolution, in many cases the change in luminance when the modification is applied is non-zero. In addition to this, often the chrominance of each pixel is not maintained; consequently the resultant images may still suffer from colour artefacts.

In a still further embodiment, modified data values are applied to identical pairs of sub-pixels from two pixels of a multi-primary display in such a way so as to maintain the luminance of each pixel. (Although the luminance of the pixel is generally unchanged, the chrominance of the pixel may be changed. This is acceptable however, as the eye is more sensitive to luminance than chrominance.)

Figure 18:
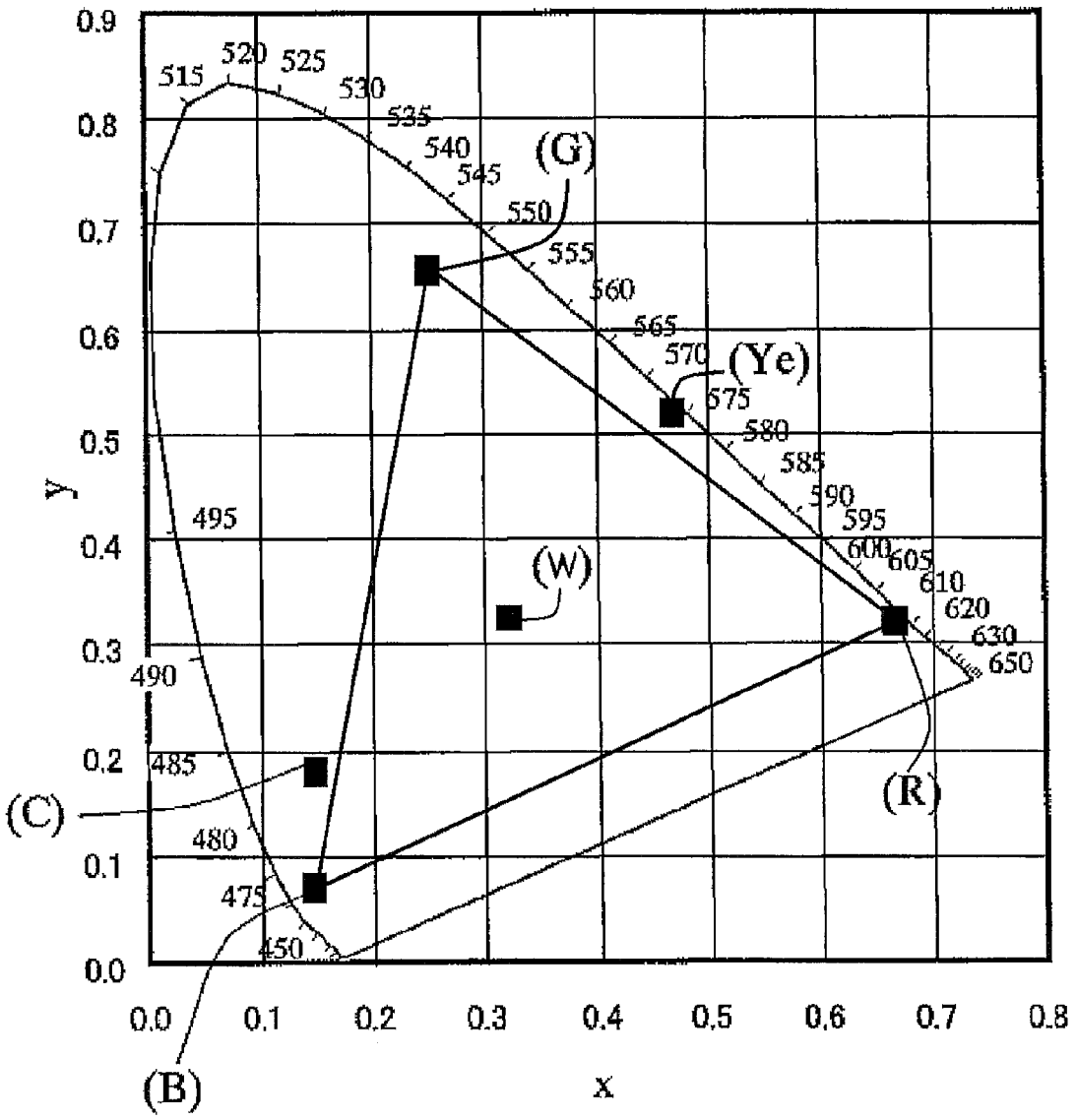
FIG. 18: Illustrates the CIE 1931 xy chromaticity diagram showing the gamut of the sRGB colour space and the locations of the three primaries, R, G and B.

To implement the current embodiment the primary sub-pixels are treated differently to the non-primary sub-pixels. In the case of an RGBX display, the red, green and blue sub-pixels are considered primary sub-pixels and all other sub-pixels, such as white and yellow sub-pixels, are considered non-primary sub-pixels. All sub-pixels apart from red, green and blue are considered non-primary as they do not significantly increase the gamut of the display. In addition, non-primary colours can be approximated using combinations of the primary colours. FIG. 18 illustrates the CIE 1931 xy chromaticity diagram showing the gamut of the sRGB colour space and the locations of the three primaries, R, G and B. The diagram also shows the location of yellow; from the diagram it is clear that the addition of yellow to red, green and blue would not significantly increase the gamut.

Each pair of pixels in a display is formed of two pixels, pixel 1 and pixel 2, each of which has four or more sub-pixels. In the first instance modifications are applied to the red, green and blue sub-pixels of the pixel pair, this is done by selecting one of the at least two modified data values stored in an LUT. The modifications applied to the red, green and blue sub-pixels of pixel 1 are all of the same type, for example the higher of the two possible output values of the LUT are selected, and the red, green and blue sub-pixels of pixel 2 are modified oppositely to the red, green and blue sub-pixels of pixel 1, for example the lower of the two possible output values of the LUT are selected. The resulting change in luminance of pixel 1 and pixel 2, caused by the first modification, is compensated for by modifying the non-primary sub-pixel(s) oppositely to the modified, primary sub-pixels of that pixel. The magnitude of the modification applied to the non-primary sub-pixels ensures that the net luminance of pixel 1 and pixel 2 is unchanged. In some cases the second modification requires the non-primary sub-pixel(s) to have a negative luminance. In this case a further modification to the pixel in question is necessary as negative luminances are impossible. The third modification requires modifying the primary sub-pixels such that the net change in luminance of this modification is equal to the negative luminance of the non-primary sub-pixel(s). This sequence of three modifications guarantees that the net change in luminance of each pixel is zero and that the average chrominance of a pair of pixels appears unchanged to an on-axis viewer.

The modifications applied to the primary sub-pixels in the first instance are all of the same type as this method gives the best improvement in colour shift. If the types of modifications applied to the primary sub-pixels in the first instance were not all of the same type, for example the higher of the two possible output values of the LUT are selected for the red and blue sub-pixels and the lower of the two possible output values is selected for the green sub-pixel, the subsequent modification to the non-primary sub-pixel(s) would be small. A smaller modification to the non-primary sub-pixel(s) results in a smaller improvement in colour shift correction.

Figure 19:
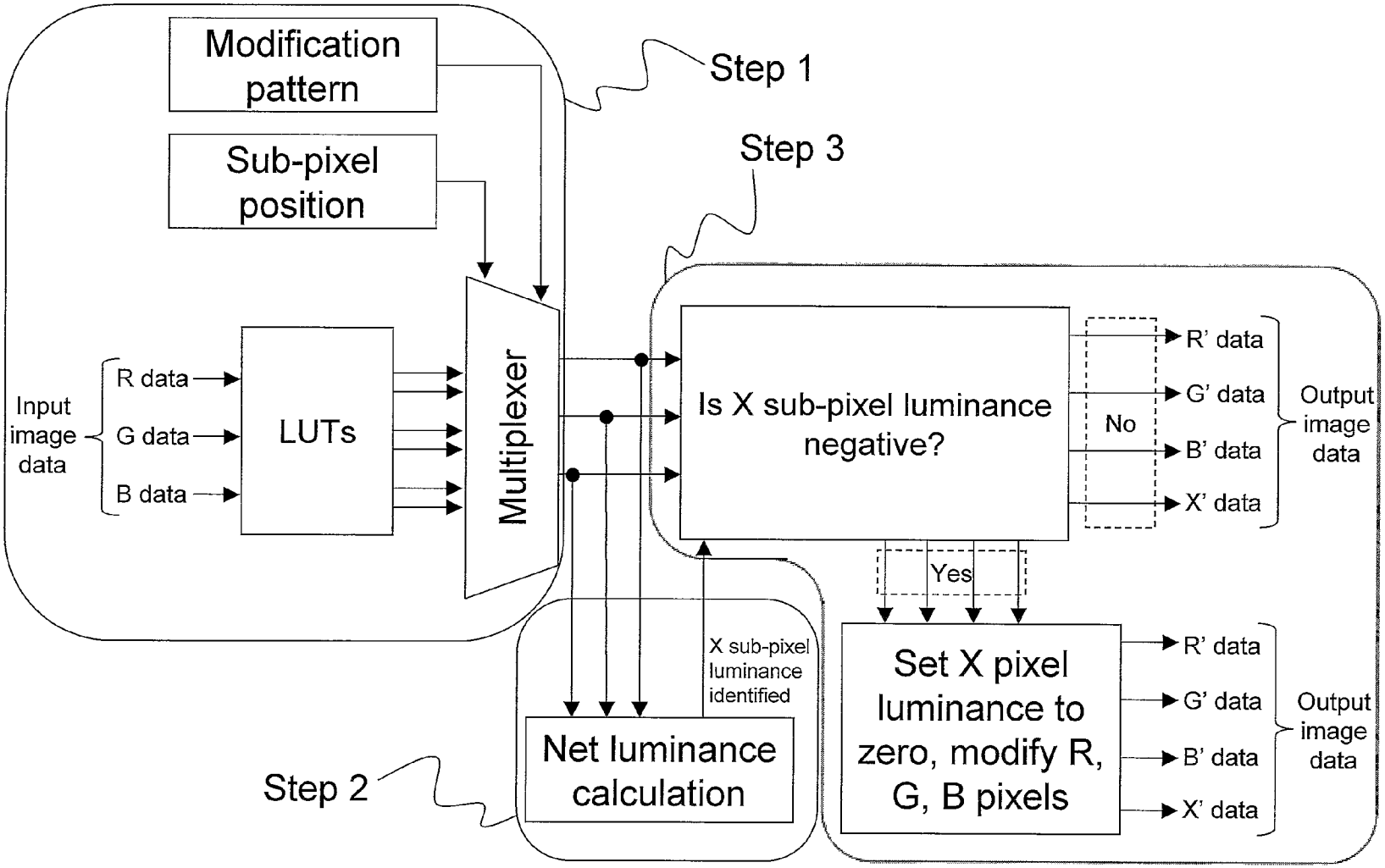
FIG. 19: Is a process flow diagram showing a possible hardware implementation in accordance with an embodiment of the invention.

The process flow of the current embodiment differs from the exemplary embodiment. FIG. 19 illustrates the process flow for the current embodiment. The diagram only shows four inputs however it must be noted that the system is not restricted to four.

Figure 20:
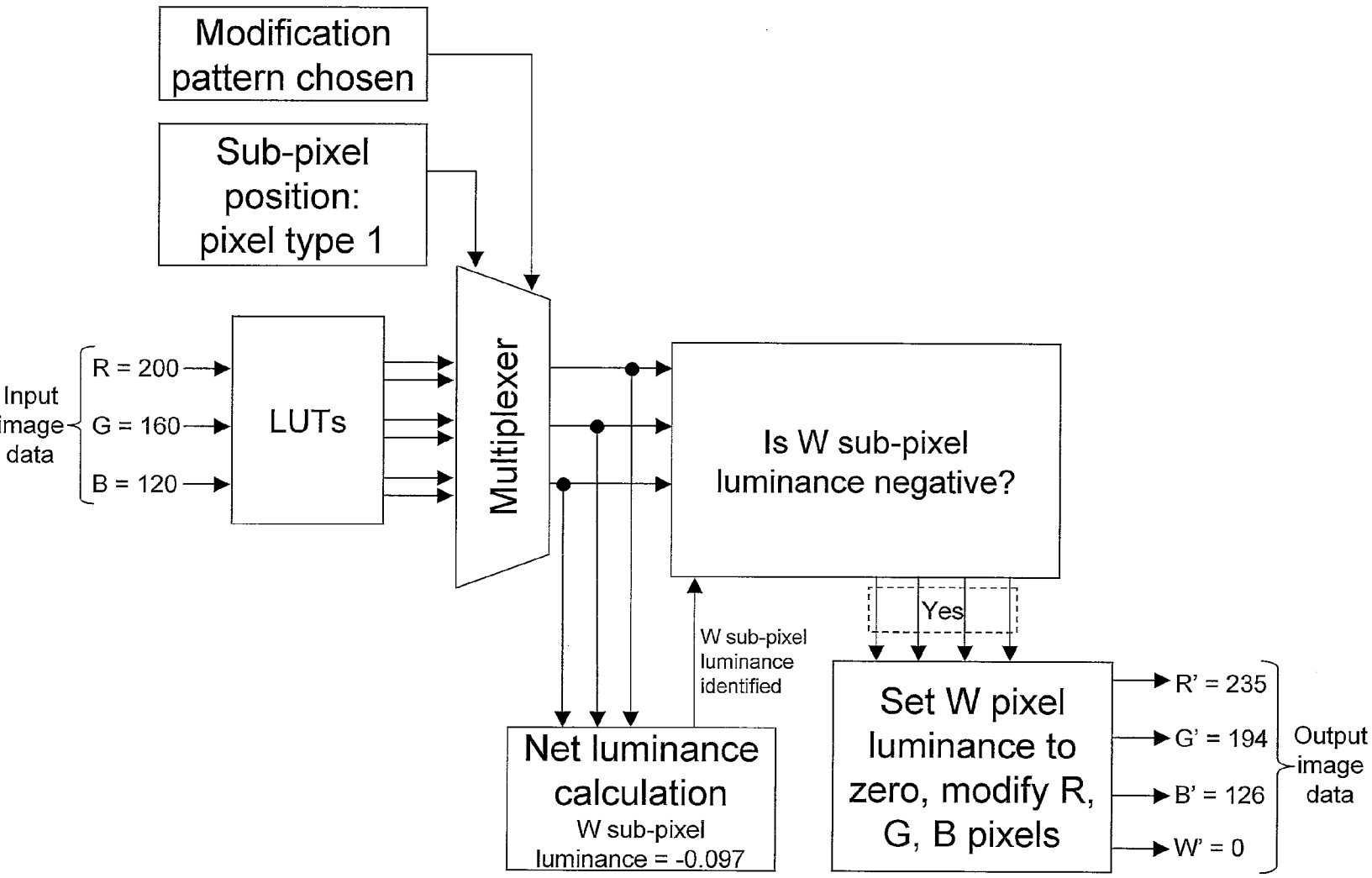
FIG. 20: Illustrates the process flow illustrated in FIG. 19 for the specific case of an input pixel with one red, one green, one blue and one white sub-pixel with data values equal to 200, 160, 120 and 120 respectively.

For example, FIG. 20 illustrates the process flow for the specific case of an input pixel, of pixel type 1, with one red, one green, one blue and one white sub-pixel with data values equal to 200, 160, 120 and 120 respectively. In the first step of the process, modifications are applied to the red, green and blue sub-pixels. In the second step, the resulting required luminance value of the white sub-pixel is calculated. And finally, in the third step, a further modification is applied to the pixel as the second step generated a negative white sub-pixel luminance which is impossible. The process flow illustrates that the output image data values are 235, 194, 126 and 0 for the red, green, blue and white sub-pixels respectively.

Figure 21:
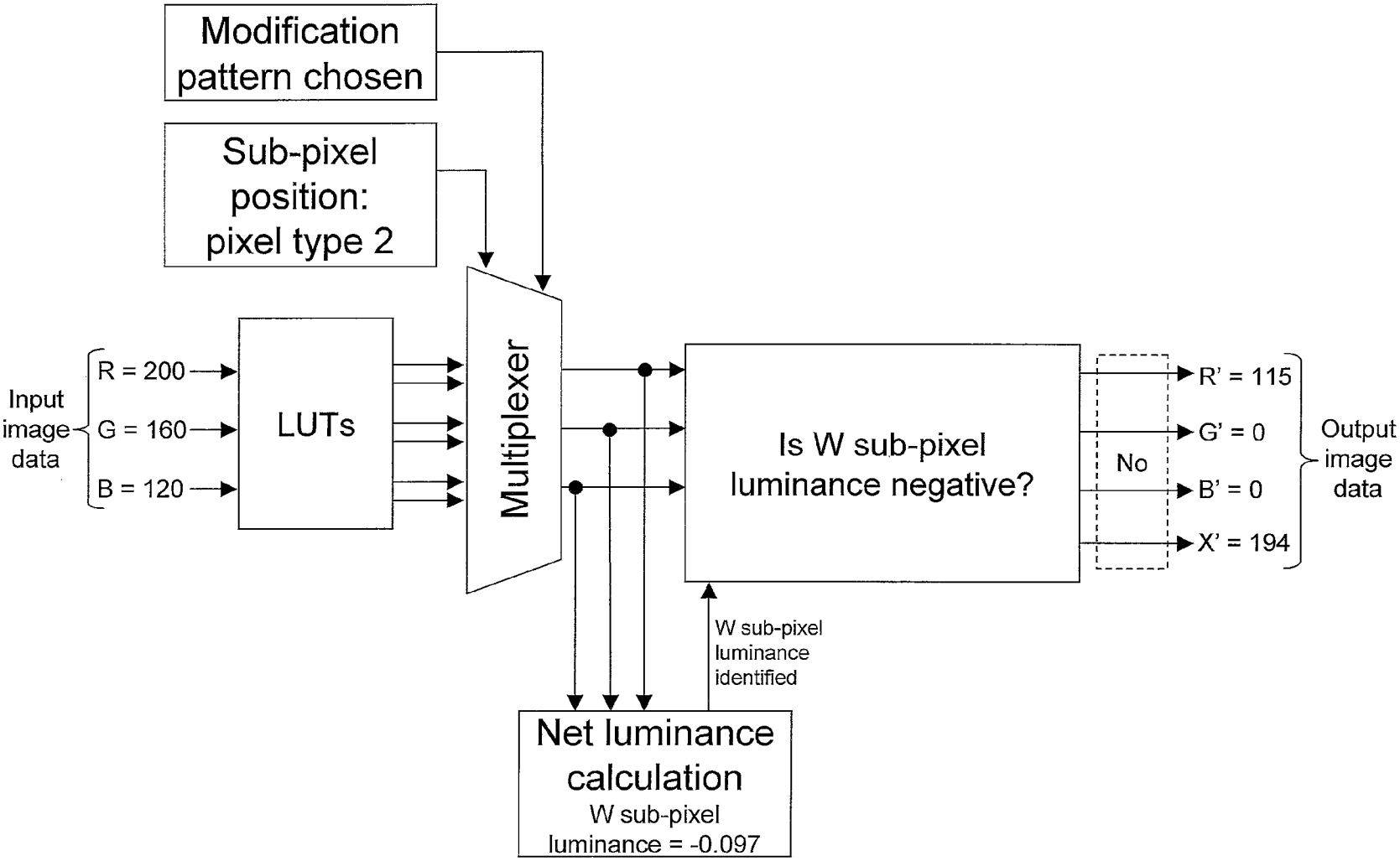
FIG. 21: Illustrates the process flow illustrated in FIG. 19 for the specific case of an input pixel with one red, one green, one blue and one white sub-pixel with data values equal to 200, 160, 120 and 120 respectively.

FIG. 21 illustrates the process flow for the specific case of an input pixel, of pixel type 2, with one red, one green, one blue and one white sub-pixel with data values equal to 200, 160, 120 and 120 respectively. In the first step of the process, modifications are applied to the red, green and blue sub-pixels. In the second step, the resulting required luminance value of the white sub-pixel is calculated. No third step is required as the luminance of the white sub-pixel is non-zero. The process flow illustrates that the output image data values are 115, 0, 0 and 194 for the red, green, blue and white sub-pixels respectively.

Whist the aforementioned embodiments ensure no luminance resolution loss, in many cases the chrominance of an individual pixel is not maintained. Consequently the resultant image suffers from chrominance resolution loss. However, it must be noted that the human eye is less sensitive to chrominance than it is to luminance. Therefore it is advantageous that pixel pairs only suffer from chrominance resolution loss and not luminance resolution loss, though the resultant image may still suffer from colour artefacts.

In a still further embodiment, modified data values are applied to the sub-pixels of a single multi-primary pixel in such a way that the net change in luminance and chrominance of the pixel is zero. This is done by modifying the sub-pixels in such a way so as to ensure that the change in luminance of one or more of the sub-pixels is exactly balanced by the change in luminance of one of more of the remaining sub-pixels. In applying this modification method it is possible to ensure that the net change in luminance and chrominance of the pixel is zero. For the specific case of a multi-primary display with one red, one green, one blue and one white sub-pixel, luminance is either transferred from the red, green and blue sub-pixels to the white sub-pixel or vice versa. For the specific case of a multi-primary display with one red, one green, one blue and one yellow sub-pixel luminance is transferred from the red and green sub-pixels to the yellow sub-pixels or vice versa. In this embodiment, it is not necessary to modify data values corresponding sub-pixels from a pair of pixels in opposite directions to one another, and each pixel may be considered independently of all other pixels.

For the specific case of a multi-primary display with one red, one green, one blue and one yellow sub-pixel no luminance transfer can occur within the pixel for the blue sub-pixel, consequently colour shift with angle may still occur for some pixels where the blue sub-pixel has a mid grey data value. To prevent this problem, modified data values can be applied to the blue sub-pixels of adjacent pairs of pixels. The modification is done in such a way that the average on-axis luminance of the pair is unchanged. However, in this case the net change in luminance and chrominance of an individual pixel is no longer zero. It is however an advantage that only the blue channel has a loss in luminance resolution as the eye has the smallest density of receptors for blue. Consequently the luminance resolution loss in the blue will be difficult for an on-axis observer to detect.

Figure 22:
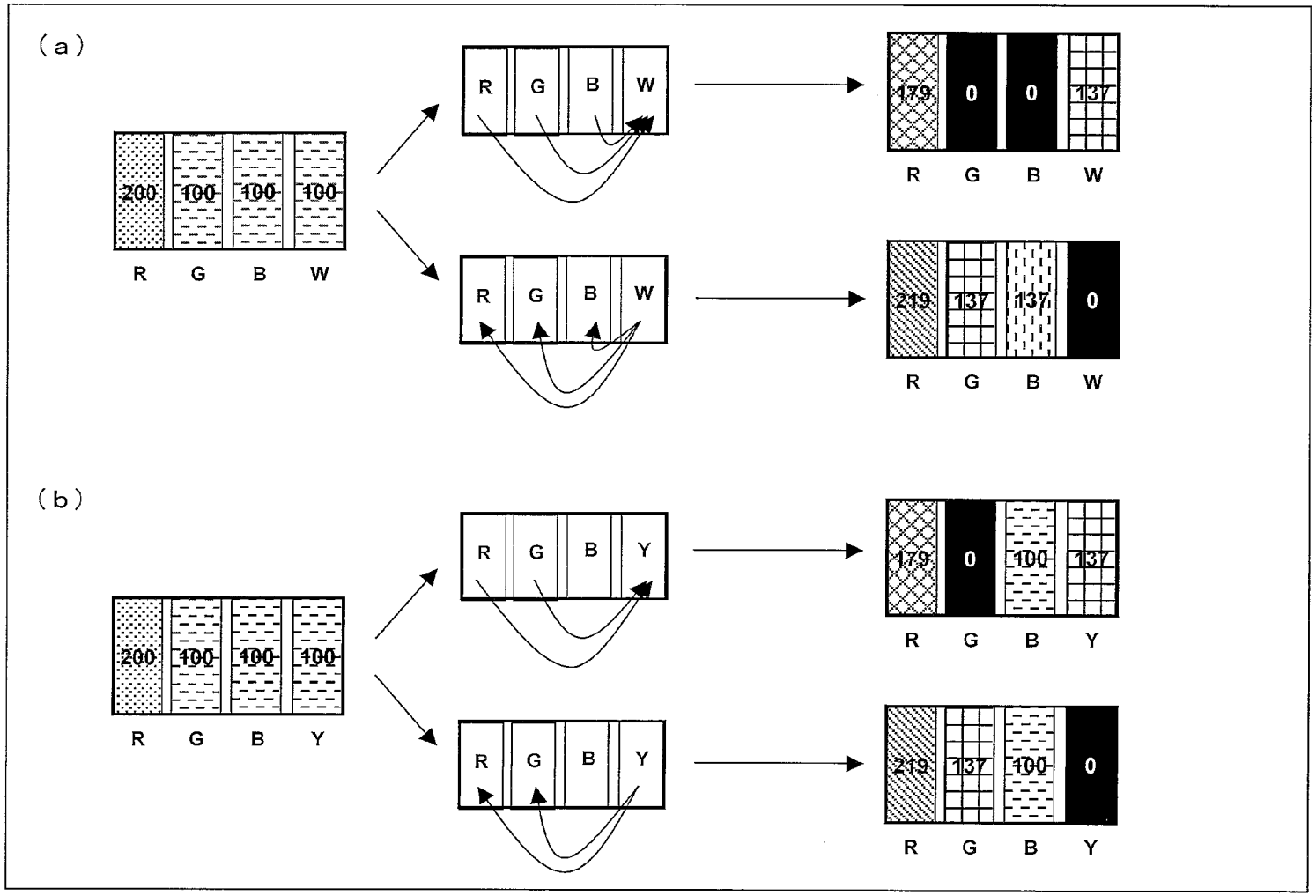
FIG. 22: (a) and (b) illustrate how luminance can be transferred between the sub-pixels of a multi-primary to ensure no luminance or chrominance resolution loss.

For example, FIG. 22(*a*) illustrates a multi-primary pixel with one red, one green, one blue and one white sub-pixel; the data values of each sub-pixel are shown on the diagram. Modifications can be applied to the pixel where luminance is transferred from the red, green and blue sub-pixels to the white sub-pixel. The resulting net change in luminance and chrominance of the pixel is zero. The example also illustrates that luminance can be transferred from the white sub-pixel to the red, green and blue sub-pixels, again ensuring the resulting net change in luminance and chrominance of the pixel is zero.

In a further example, FIG. 22(*b*) illustrates a multi-primary pixel with one red, one green, one blue and one yellow sub-pixel; the data values of each sub-pixel are shown on the diagram. Modifications can be applied to the pixel where luminance is transferred from the red and green sub-pixels to the yellow sub-pixel. The resulting net change in luminance and chrominance is zero. The example also illustrates that luminance can be transferred from the yellow sub-pixel to the red and green sub-pixels, again ensuring the resulting net change in luminance and chrominance of the pixel is zero.

Figure 23:
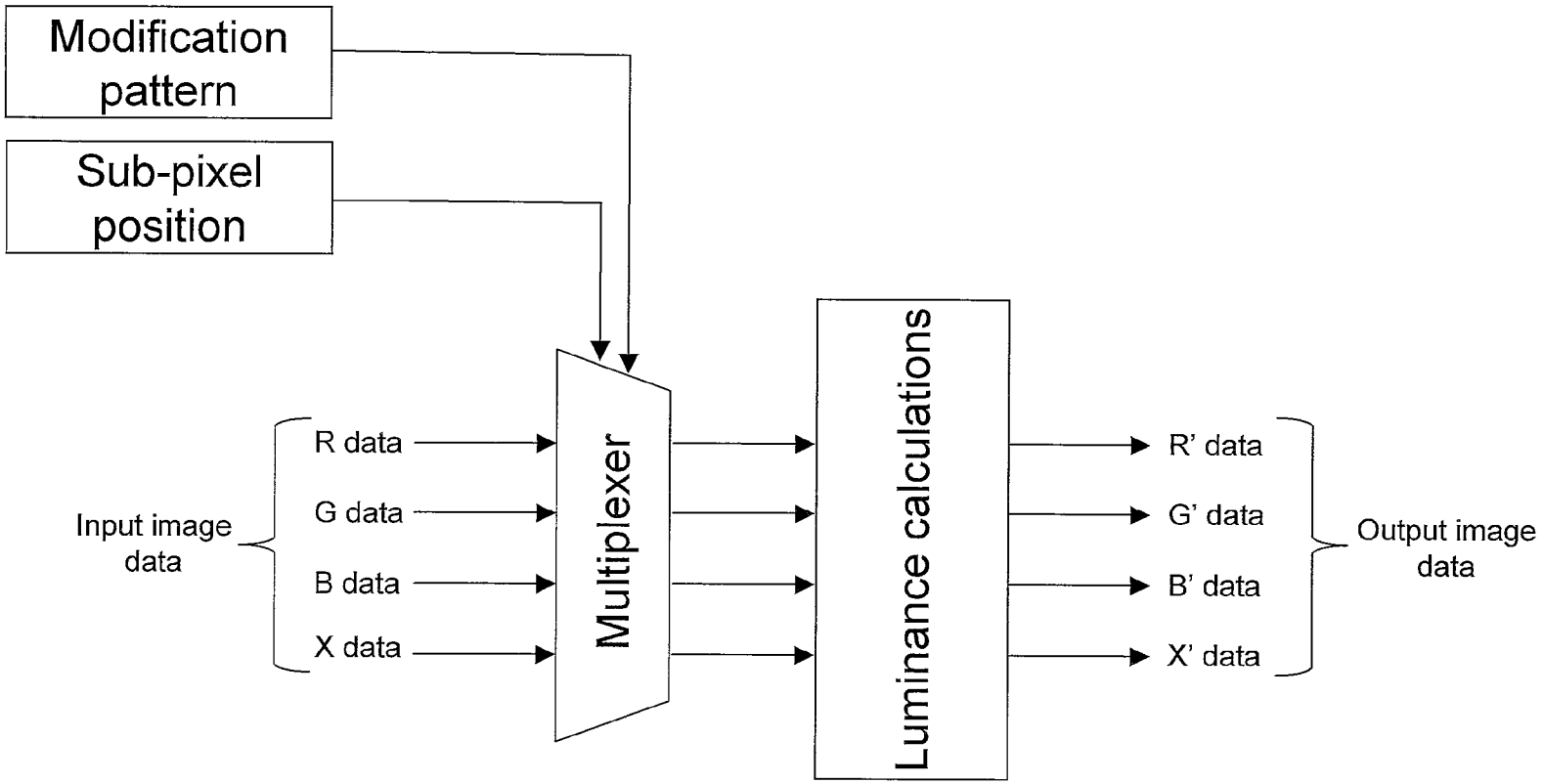
FIG. 23: Is a process flow diagram showing a possible hardware implementation in accordance with an embodiment of the invention.

It may be more optimal to implement the current embodiment using luminance calculations that identify the desired modified data values instead of using LUTs. FIG. 23 illustrates the process flow for the current embodiment. The diagram only shows four inputs however it must be noted that the system is not restricted to four.

The frame inversion drive method described in US 2010 0156774 can be applied to the embodiments described above. In this case the type of modification that is applied to a particular sub-pixel, i.e. either an increase in luminance or a decrease in luminance, is changed every frame so that changes to the data values applied to a sub-pixel are coordinated with changes in drive polarity of the sub-pixel. When this drive method is implemented on a process that requires LUTs the output values of the LUTs should be calculated so as to take into account the switching speed of the LC. The advantage of this frame inversion drive method is that no luminance or chrominance resolution loss is visible over a period of two frames. There is only benefit in applying this scheme to embodiments where some luminance and/or chrominance resolution loss is visible.

Figure 28:
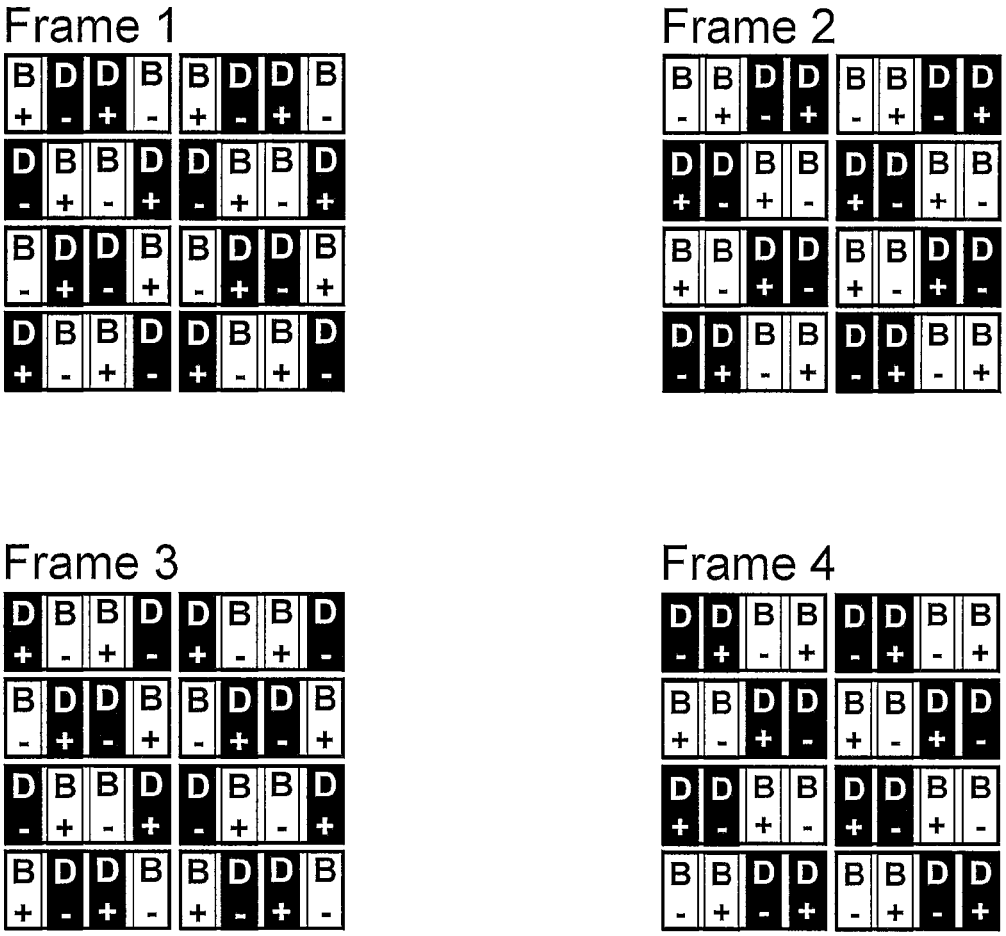
FIG. 28: Illustrates another modification pattern applied to RGBY panels with a 2 line dot inversion polarity pattern. The refresh rate of the image and polarity pattern are the same.

US 2010 0156774 states that the above frame inversion drive method suffers from dc balancing problems that lead to image sticking. The patent states that the problem can be avoided by inverting the spatial pattern of which of the two output data values for each input data value is selected every two image frames, rather than every frame. This method has the drawback that four frames are now required for a full cycle of output data values, and for a typical 60 Hz refresh display, the frequency of the output image cycle is 15 Hz, and flicker may be observed. The patent states that displays with refresh rates of 120 Hz and 240 Hz are now becoming more common and therefore the solution will be more applicable in this case. However, 120 Hz and 240 Hz refresh displays have the disadvantage of higher power consumption when compared to 60 Hz refresh displays. Consequently it is advantageous to use a scheme where the refresh rate of the image is 60 Hz and the refresh rate of the polarity of the applied voltage is 30 Hz or more generally where the refresh rate of the polarity of the applied voltage is half that of the image. Another possible scheme to combat the problems of image sticking may be to use a four frame cycle where half the pixels are inverted every 2 frame starting at frame 1 and the other half of the pixels are inverted every 2 frames starting at frame 2. This scheme is illustrated in FIG. 28. These schemes ensure good dc balancing and could also be applied to RGB panels.

Figure 24:
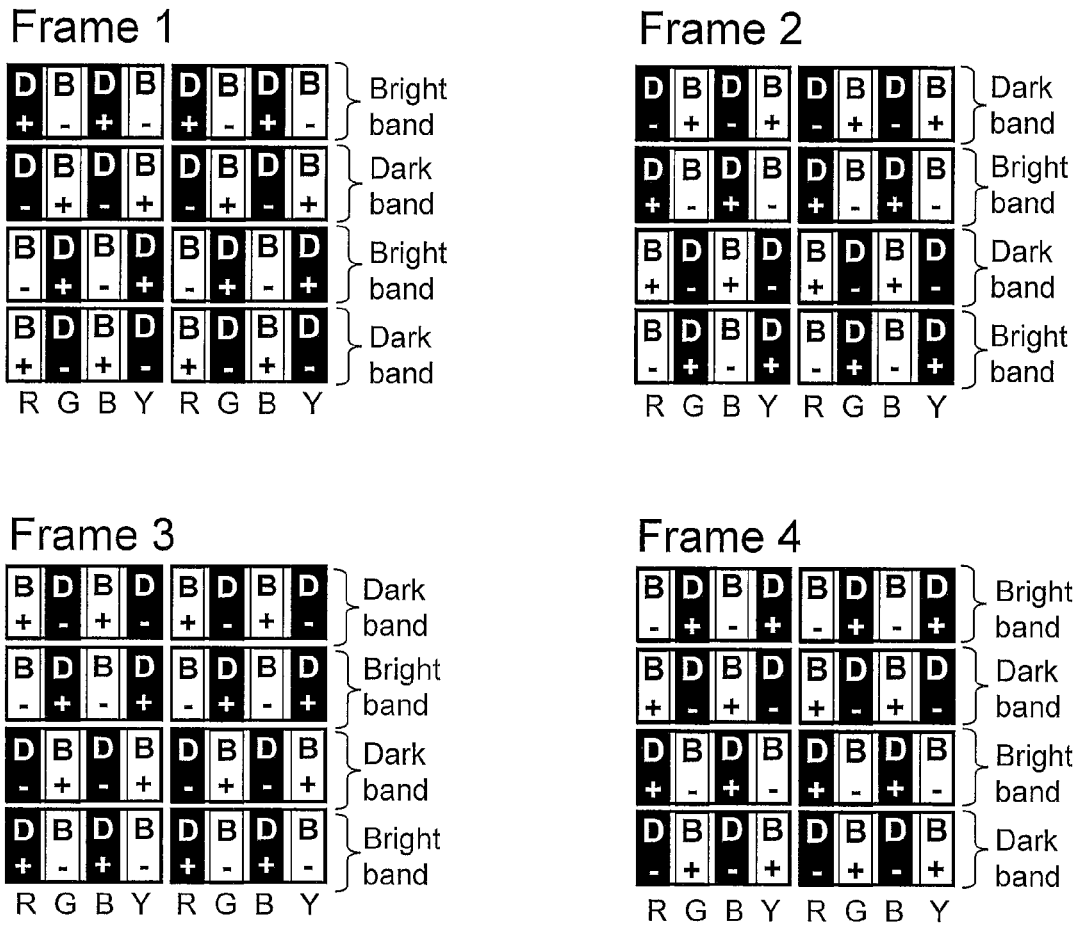
FIG. 24: Illustrates a modification pattern applied to RGBY panels with a 2 line dot inversion polarity pattern. The refresh rate of the image and polarity pattern are the same.
Figure 25:
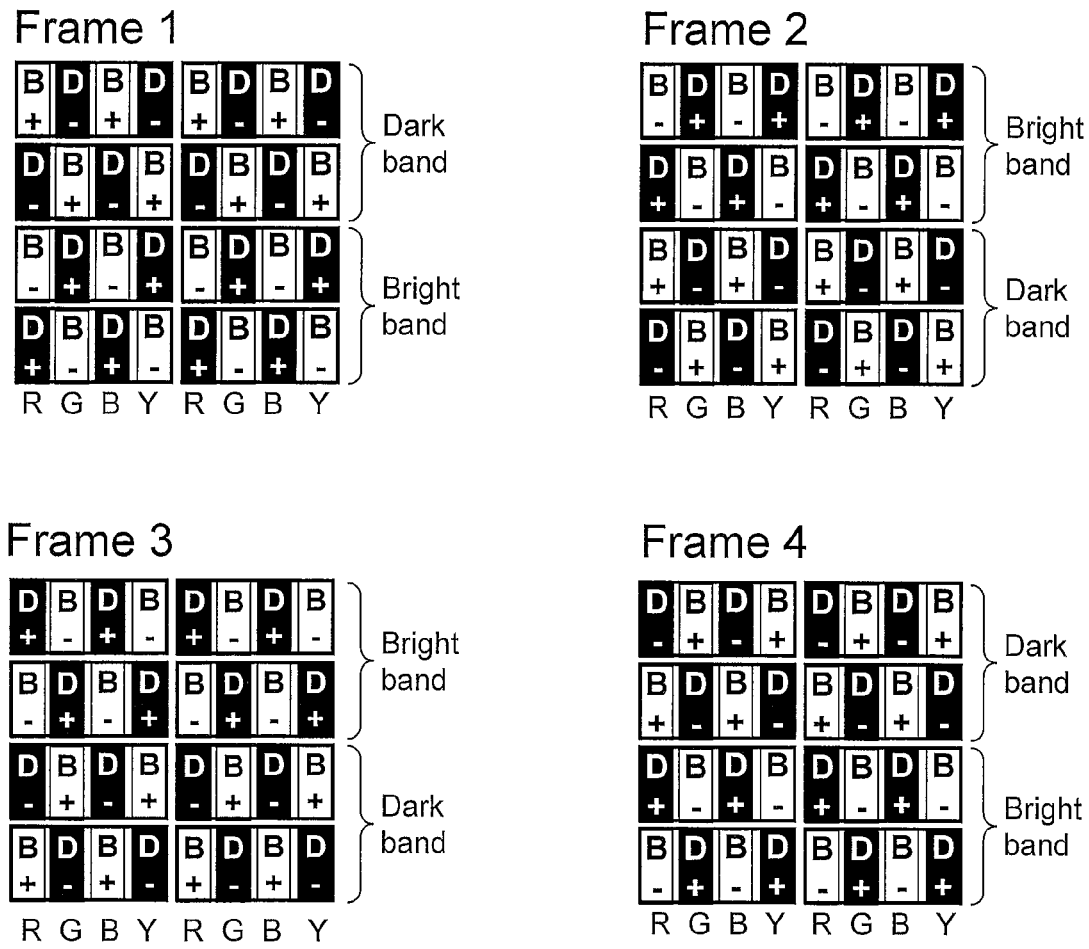
FIG. 25: Illustrates another modification pattern applied to RGBY panels with a 2 line dot inversion polarity pattern. The refresh rate of the image and polarity pattern are the same.
Figure 26:
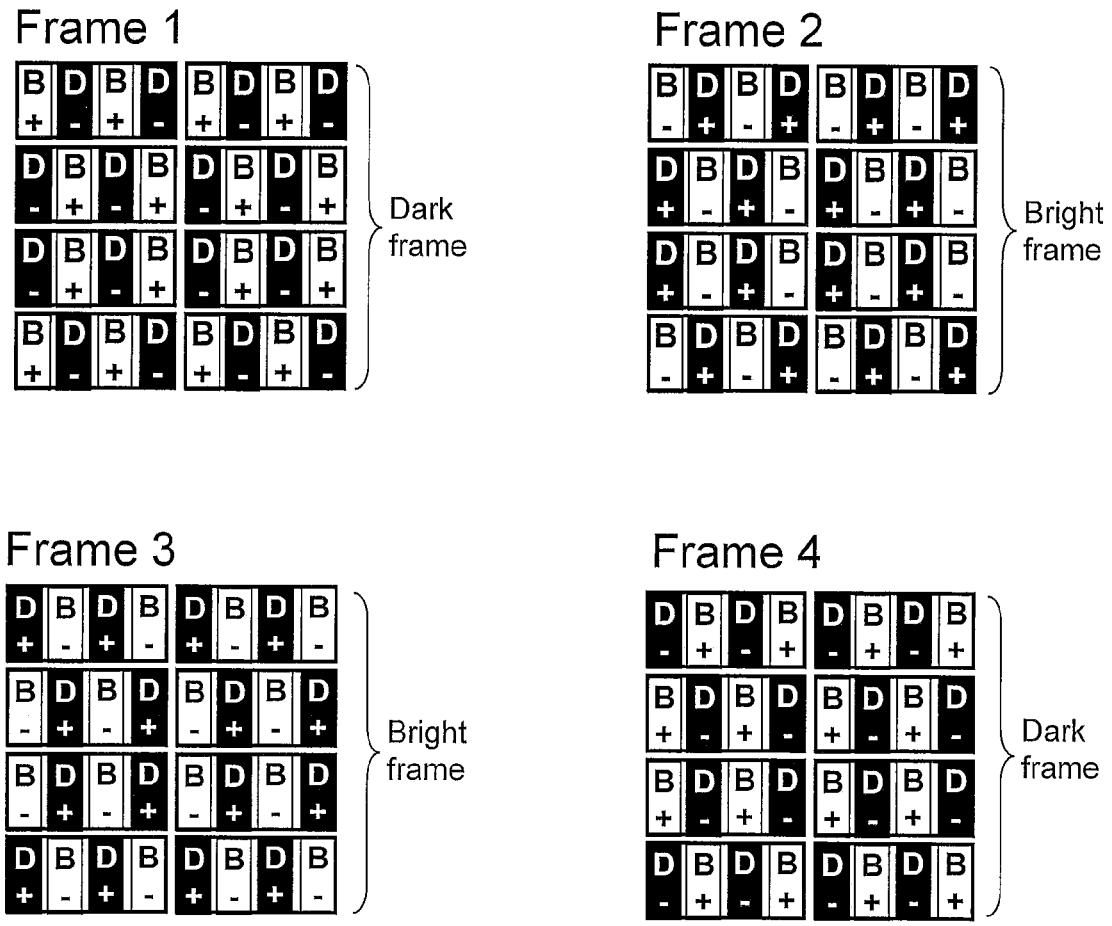
FIG. 26: Illustrates another modification pattern applied to RGBY panels with a 2 line dot inversion polarity pattern. The refresh rate of the image and polarity pattern are the same.
Figure 27:
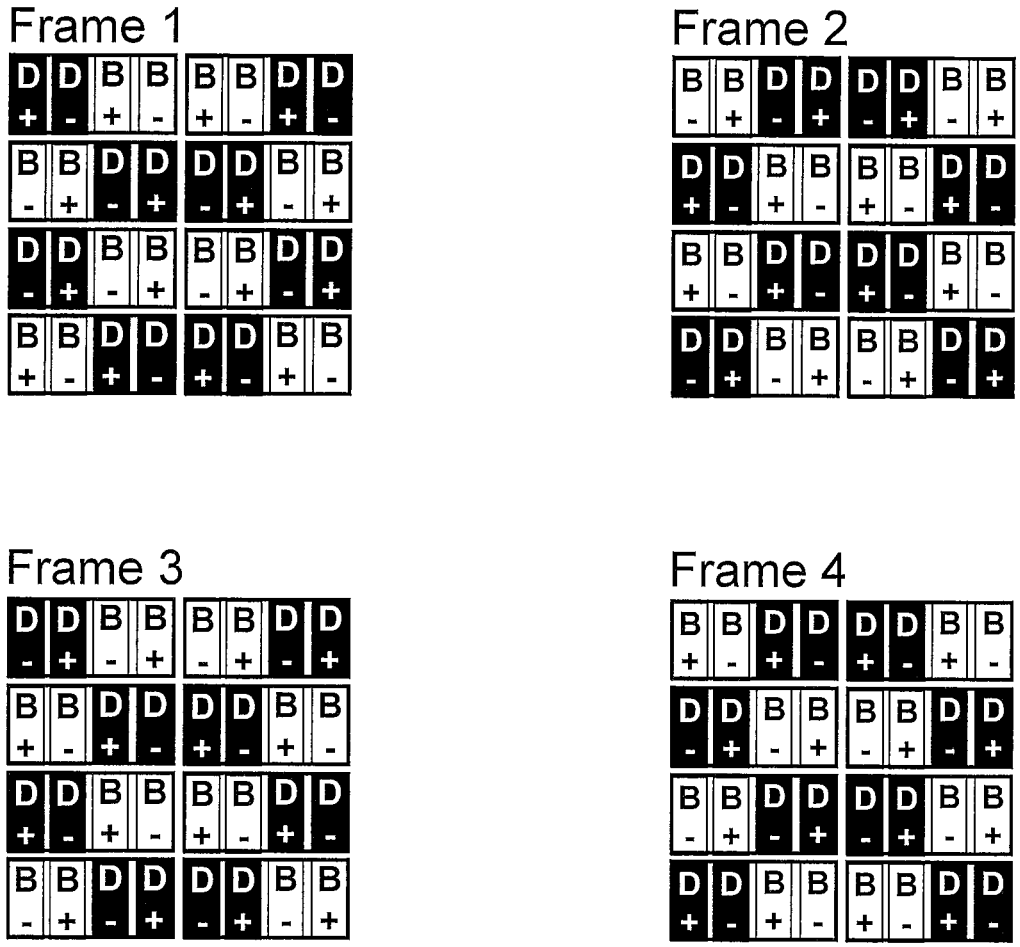
FIG. 27: Illustrates another modification pattern applied to RGBY panels with a 2 line dot inversion polarity pattern. The refresh rate of the image and polarity pattern are the same.

When applying the frame inversion method to the first exemplary embodiment is it important to ensure that no artefacts such as banding, flickering or crosshatching are visible. Banding can be visible when all the bright sub-pixels of a row or column are of one polarity and all the bright sub-pixels of the adjacent row or column are of the other polarity. This can occur for specific combinations of modification patterns and polarity patterns, two examples where banding can be visible are given in FIG. 24 and FIG. 25. The aforementioned examples are for RGBY multi-primary panels with a 2 line dot inversion polarity pattern and 120 Hz refresh rate. One line horizontal banding can be visible in FIG. 24 and two line horizontal banding can be visible in FIG. 25. Flickering is visible when all the bright sub-pixels of a frame are of one polarity and all the bright sub-pixels of the next frame are of the other polarity. This can occur for specific combinations of modification patterns and polarity patterns; an example is given in FIG. 26. The aforementioned example is for an RGBY multi-primary panel with a 2 line dot inversion polarity pattern and 120 Hz refresh rate. Crosshatching can be visible when a particular modification pattern is applied to moving smooth or uniform images. FIG. 27 illustrates an example of a modification pattern that can lead to visible crosshatching in smooth image areas when the image is moving horizontally by one pixel every frame. The aforementioned example is for an RGBY multi-primary panel with a 2 line dot inversion polarity pattern, 120 Hz image refresh rate and 60 Hz polarity pattern refresh rate.

Figure 29:
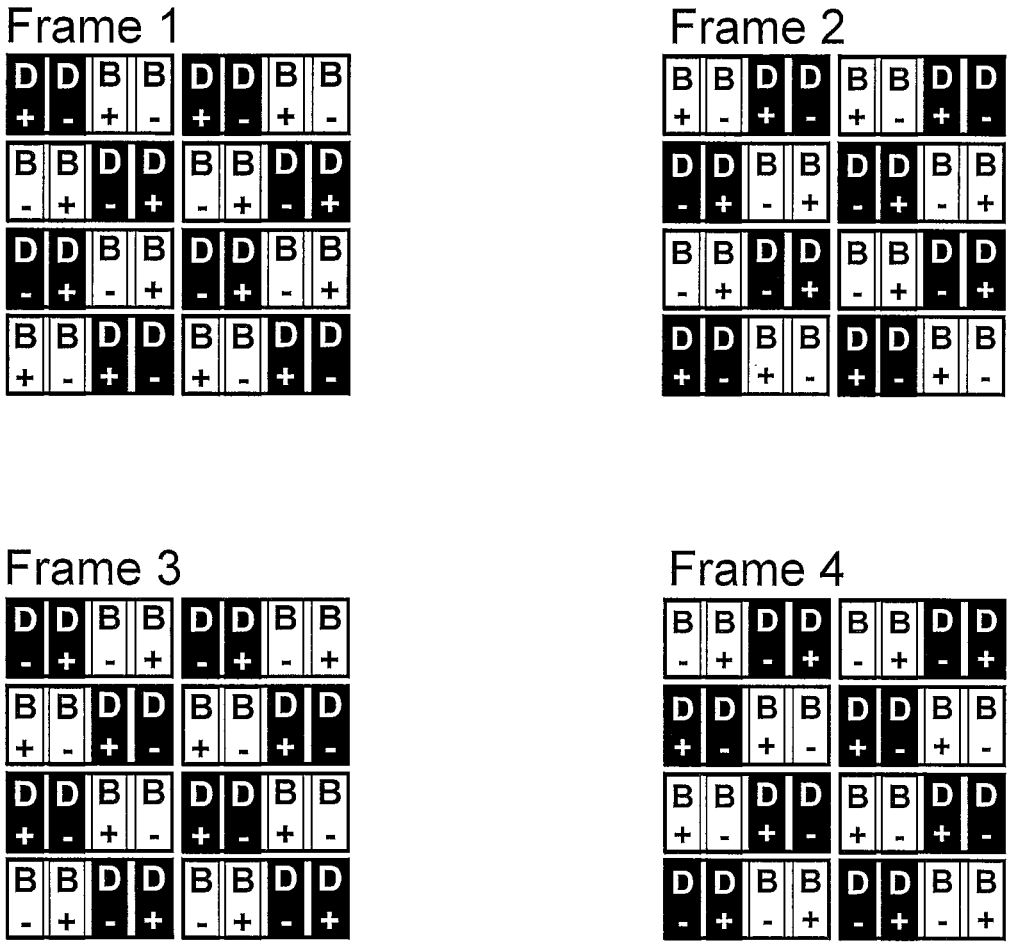
FIG. 29: Illustrates a modification pattern applied to an RGBY panel with a 2 line dot inversion polarity pattern. The refresh rate of the image is twice that of the polarity pattern.
Figure 33:
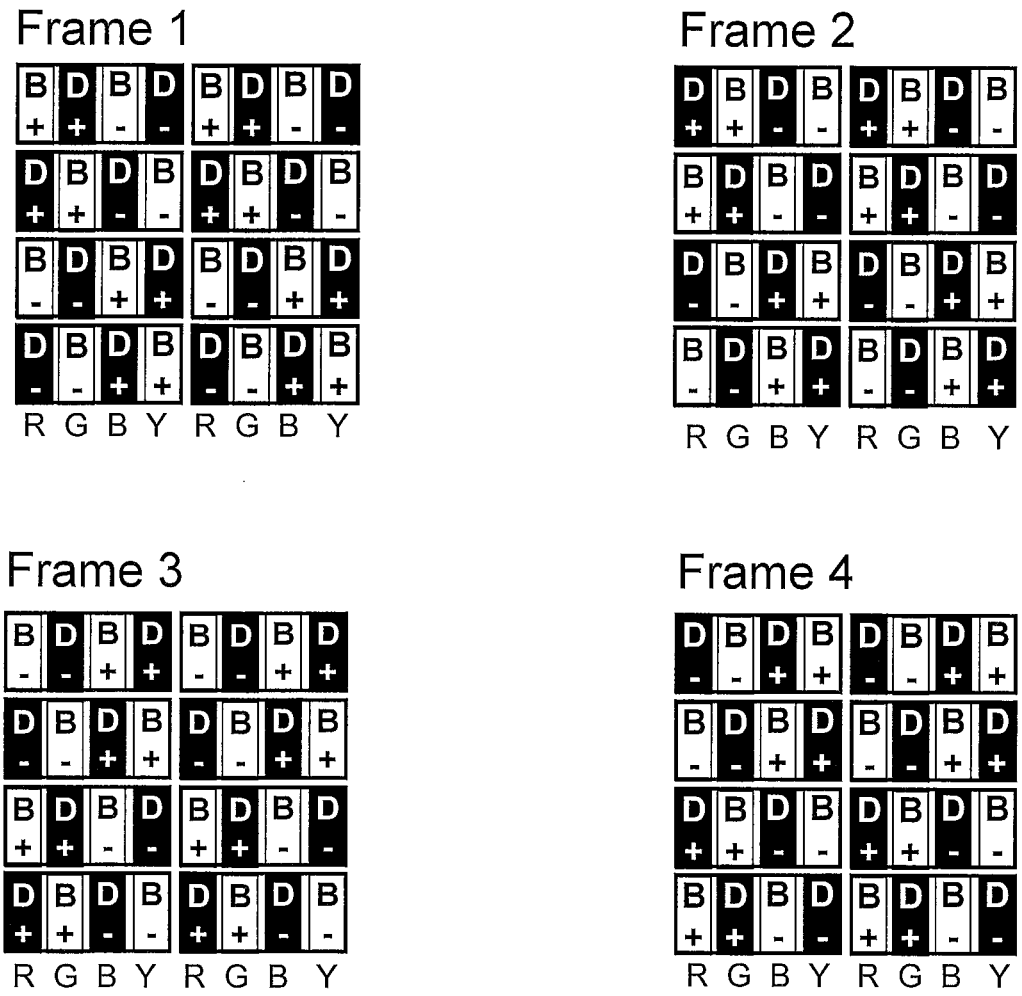
FIG. 33: Illustrates a modification pattern applied to an RGBY panel with a 2 line 2 dot inversion polarity pattern. The refresh rate of the image is twice that of the polarity pattern.

Examples of specific combinations of modification patterns and polarity patterns that do not result in any artefacts such as banding, flicker or crosshatching are given in FIG. 28, FIG. 29 and FIG. 33. The example illustrated in FIG. 28 is for an RGBY multi-primary panel with a 2 line dot inversion polarity pattern and 120 Hz refresh rate. The example illustrated in FIG. 29 is for an RGBY multi-primary panel with a 2 line dot inversion polarity pattern, 120 Hz image refresh rate and 60 Hz polarity pattern refresh rate. The example in FIG. 33 is for an RGBY multi-primary panel with a 2 line 2 dot inversion polarity pattern, 120 Hz image refresh rate and 60 Hz polarity pattern refresh rate. The above examples are for RGBY multi-primary panels, but use of these embodiments to obtain artefact free images is not restricted to RGBY multi-primary panels.

The colour artefact prevention method described in US 2010 0156774 can also be applied to the aforementioned embodiments that suffer from colour artefact problems. This method prevents any modifications being applied to pixels that result in colour artefacts when the modifications are applied. The main disadvantage of the above method is that no improvement in colour shift is achieved for pixels where the modifications have been prevented. Consequently adjacent pixels of the same data value, where one has had the colour artefact prevention method applied and the other has not, do not appear the same to an off-axis viewer. This is not a desirable effect.

Figure 30:
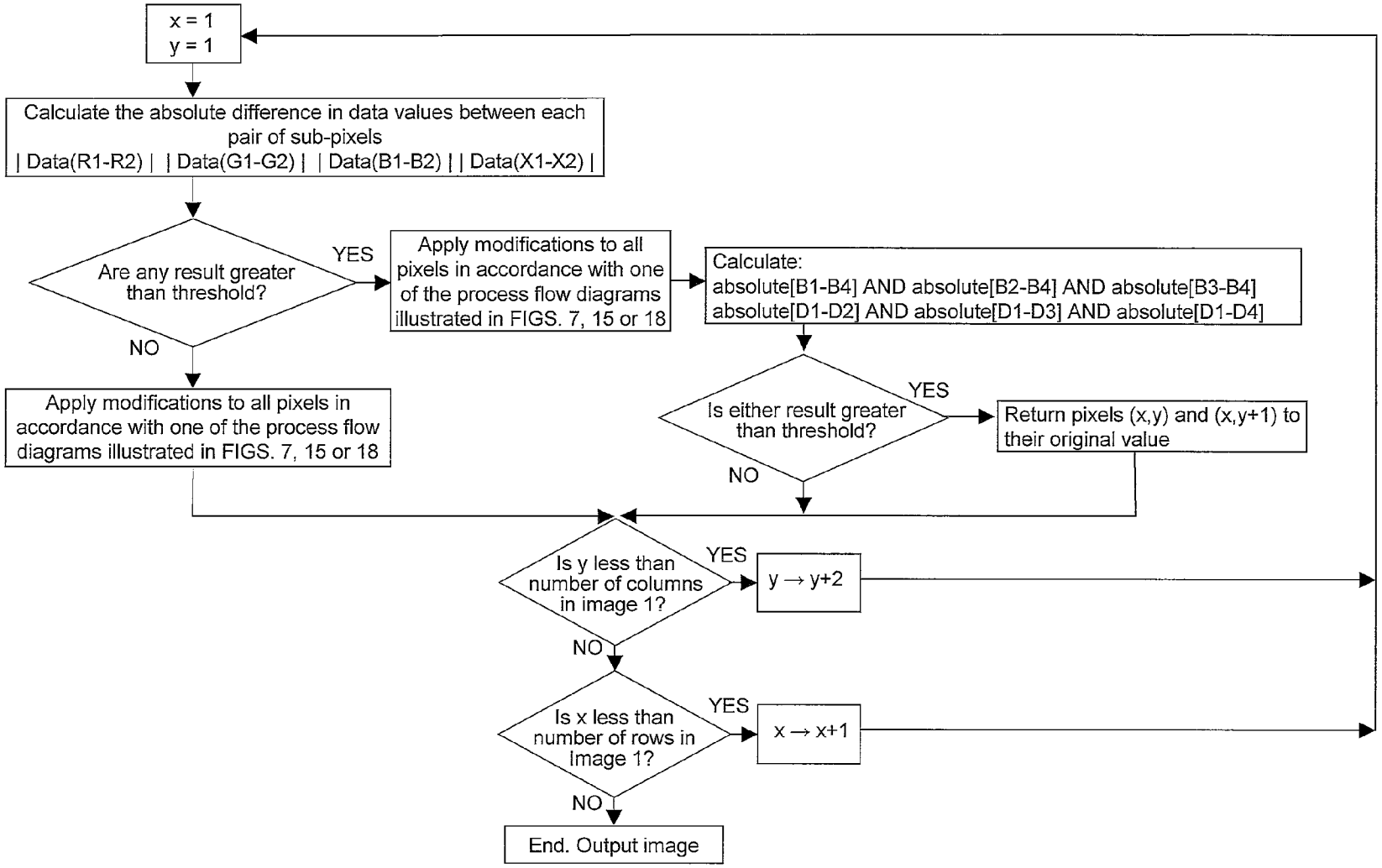
FIG. 30: Illustrates a method for preventing colour artefacts whilst still achieving improvements in the off-axis images.

In some cases it is possible to prevent colour artefacts whilst still achieving improvements in colour shift. The modified data values that result from the process flow diagrams illustrated in FIGS. 8, 16, and 19 can all result in colour artefacts. These artefacts can be prevented by applying the method illustrated in FIG. 23 only to pixels that result in colour artefacts. The method illustrated in FIG. 23 ensures that the net change in luminance and chrominance of the pixel is zero and therefore ensures that no colour artefacts are visible. FIG. 30 illustrates a method for detecting and preventing colour artefacts whilst still achieving improvements in colour shift for some problematic pixels. In the first instance the absolute differences in data values between identical sub-pixels of adjacent pixels of the original image are calculated. Modifications are then applied to all pixels in accordance with one of the process flow diagrams illustrated in FIG. 8, 16 or 19. If the absolute difference in data values previously calculated is less than the threshold value both pixels in the pair do not results in colour artefacts and the method moves on to the next pair of pixels. If the absolute difference in data values previously calculated is greater than the threshold value a second calculation is carried out based on the modified sub-pixel data values. FIG. 31 gives an example of the second calculation. The absolute differences in data values between the bright sub-pixels of adjacent modified pixels are calculated and the absolute differences in data values between the dark sub-pixels of adjacent modified pixels are calculates. If either result is greater than the threshold value the pixel pair is returned to its original value and modifications according to the process flow diagram in FIG. 23 are applied to the pixel pair instead.

In a still further embodiment colour shift can be eliminated or reduced by maintaining the position or reducing the change in position in a particular colour space for each pixel with angle. This can be done in either the CIEXYZ or CIELAB colour spaces for example. The combination of sub-pixel data values which best maintains the position with angle is selected. This method may be implemented in several different ways.

Figure 32:
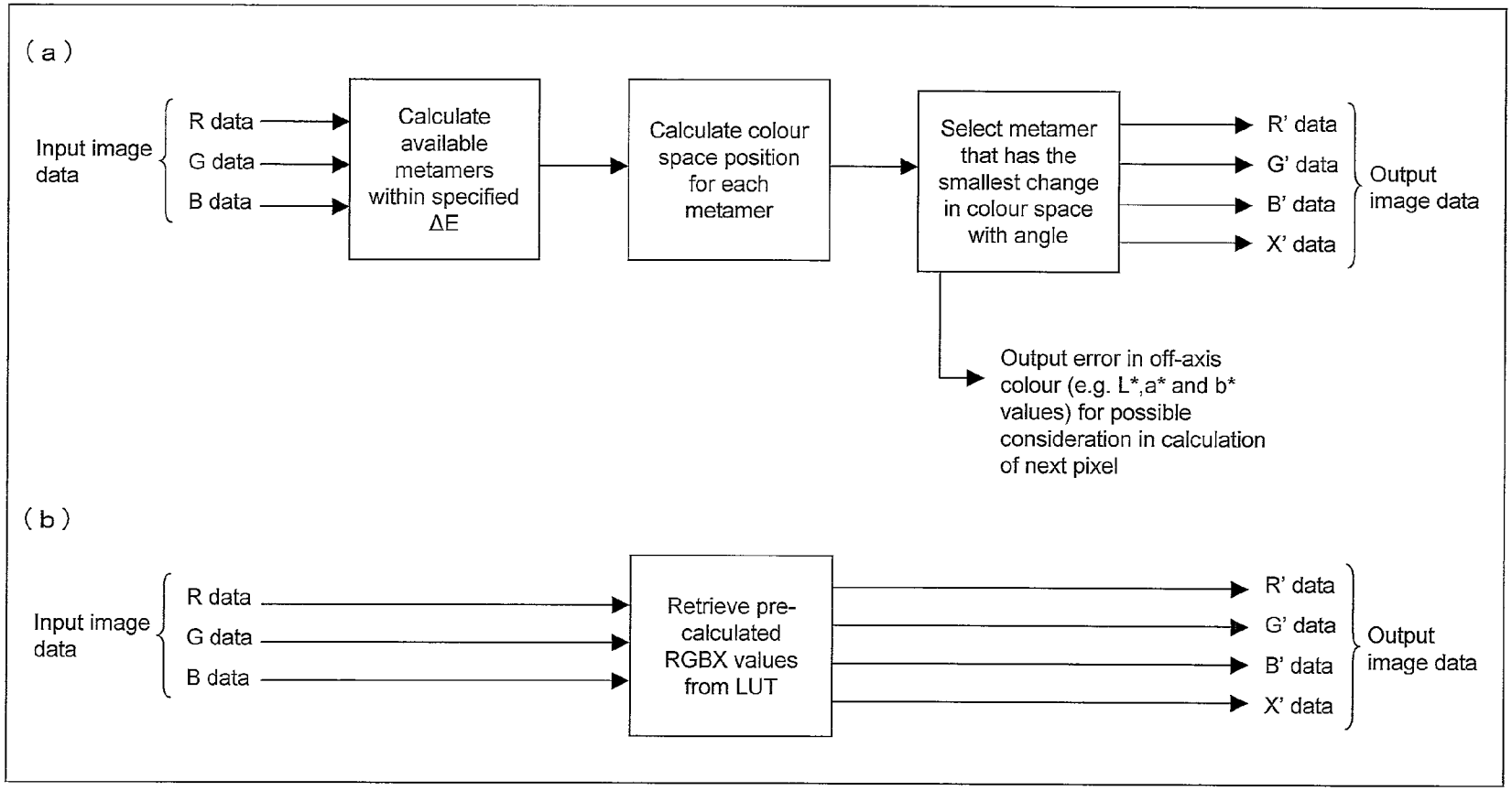
FIG. 32: (a) and (b) are process flow diagrams illustrating two possible implementations of an embodiment of the present invention.

For each pixel in the display, a calculation may be performed in order to select the best combination of sub-pixel data values which best maintains the position with angle as the image data is input to the display. In order to operate at video rate, this calculation would have to be fast however, and the number of sub-pixel data value combination to be considered may be prohibitive. It may be more practical to precalculate the on-axis colour space positions for each combination of sub-pixel data values and store these results in an LUT, for later retrieval, according to the data values input to the display. However, again due to the number of sub-pixel data value combinations, the memory required for storage of such an LUT may be prohibitive. Process flows of these possible implementations are shown in FIGS. 32 (*a*) and 32 (*b*) respectively. It may be even more practical to perform a calculation which, for each set of sub-pixel data values input to the panel, the set of available on-axis metamers is calculated, and the metamer which results in the smallest change in position with angle is selected from this set. The method of calculation of metamers may be similar to that described in US 2010 0277498 A1. If a certain amount of tolerance is allowed in the colour space values of the calculated available metamers, an increased set of metamers may be available for each combination of sub-pixel data values. This may mean that a metamer with a smaller change in position with angle may be found. This degree of tolerance may be specified according to the Euclidean distance in the colour space between the ideal position according to the input data, and the actual position of each metamer. Such colour difference measures are well known for several colour spaces, such as the ΔE calculation in CIELAB colour space.

$$\Delta E=\sqrt{(L_1-L_2)^2+(a_1-a_2)^2+(b_1-b_2)^2}$$

The degree of tolerance may be specified to be wider for the chrominance data values than for the luminance values of the input data. It may also be advantageous for generating a greater number of metamers from which to pick an optimum for outputting, to consider metamers for groups of two or more pixels which have an average luminance and chrominance within a given tolerance of the average luminance and chrominance of the same group in the input image. It may also be useful to consider metamers for groups of pixels which have an average chrominance of the group of pixels within a given tolerance of the average chrominance of the group in the input image data, and an average luminance of each of the individual pixels within a different given tolerance of the individual luminance values for the same pixels in the input image data. In this way, chrominance resolution of the output image may be sacrificed to allow metamers with reduced angular viewing variation, while maintaining luminance resolution of the output image.

If none of the available metamers produce an acceptable change in position with angle, the best available metamer may be selected, whilst the difference between the target and output metamer colour values may be stored, for inclusion in the calculation for the next, for example neighbouring, pixel, in an error diffusion type process.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

Industrial Applicability

The present invention can provide a display that has improved off-axis display quality, without any significant degradation of on-axis display quality. A display method of the invention, or a control circuit or display of the invention, may be used in any application where good display quality is desired for both on-axis and off-axis viewers.

Conclusion

The present invention provides an optimised method of reducing colour shift with viewing angle in multi-primary LCDs. Existing methods, such as the hardware split sub-pixel architecture, have the disadvantage of added pixel electronics and the method is not applicable to high resolution, small area displays; the software split sub-pixel architecture also has limitations, the images suffer from an effective loss in luminance resolution as well as colour artefacts. The present invention addresses these disadvantages.

A first aspect of the present invention provides a method of processing an image for display, the method comprising: obtaining pixel data constituting an image, each pixel data including at least four sub-pixel colour components having respective data values; and, for each of the pixel data, modifying one or more of the sub-pixel colour component data values; wherein the method comprises modifying the data values of corresponding sub-pixels from a pair of pixels in opposite directions to one another and such that the overall luminance of the display panel and the perceived image appear substantially unchanged to an on-axis viewer of the display panel.

The pixel data including at least four sub-pixel colour components may be obtained from an external source—for example, a display device may be supplied with pixel data including at least four sub-pixel colour components. The invention does not however require that the pixel data including at least four sub-pixel colour components is obtained from an external source. As is known, in many multiprimary displays, the display control electronics accept RGB data only, and the data for additional sub-pixels is generated using a gamut mapping algorithm or some other calculation—and the present invention may be applied to such as display as well as to a display in which input to the display control electronics already consists of 4 or more channel (such as separate R, G, B and W channels).

The overall change in luminance and chrominance for the pixel pair should be zero, since the change in luminance and/or chrominance of one pixel of the pair should be equal and opposite to the change in luminance and/or chrominance of the other pixel of the pair. However, there may be a change in luminance and/or chrominance of an individual pixel as a result of the modification of the sub-pixel colour component data value(s) (although the presence of four (or more) sub-pixels means that change in luminance of a pixel is often smaller than when prior art correction methods are applied to a convention RGB display).

The pair of pixels may be two pixels in a frame that are spatially close to one another so that the eye of an observer can average the luminance of the two pixels. The two pixels may be neighbouring pixels in a frame, although the invention is not limited to neighbouring pixels. In this embodiment the present invention is preferably applied to each pixel pair in a frame.

Alternatively, the pair of pixels may have the same spatial position as one another but occur in two different, but consecutive, frames. Again, the eye of an observer can average the luminance of the two pixels since the two pixels occur in consecutive frames. In this embodiment the present invention is preferably applied to each pixel pair formed by a pixel of a frame and the corresponding pixel of the next frame).

As is known, the term "multi-primary display" relates to a display that includes pixels or sub-pixels of at least one further colour in addition to pixels or sub-pixels of three primary colours. The pixels or sub-pixels of the at least one further colour are referred to herein as "non-primary" pixels or sub-pixels, and the pixels or sub-pixels of three primary colours are referred to herein as "primary" pixels or sub-pixels.

As an example, one group of "multi-primary displays" include pixels or sub-pixels of at least one further colour in addition to red, green and blue pixels or sub-pixels—such displays may be referred to as "RGBX" displays, where the "X" denotes the presence of pixels or sub-pixels of at least one further colour in addition to red, green and blue. Specific examples of multi-primary displays are a display that include white pixels or sub-pixels in addition to red, green and blue pixels or sub-pixels (referred to as an RGBW display), or that includes yellow pixels or sub-pixels in addition to red, green and blue pixels or sub-pixels (referred to as an RGBY display). In principle the invention may also be applied with a CMYX multi-primary display.

Specifying that the data values of corresponding sub-pixels of two pixels are modified "in opposite directions" to one another indicates that the data value of one sub-pixel is altered so as to increase the luminance of that sub-pixel (that is, supplying the modified data value to the sub-pixel produces a greater sub-pixel luminance than does supplying the unmodified data value) while the data value of the corresponding sub-pixel is altered so as to decrease the luminance of that sub-pixel (that is, supplying the modified data value to the sub-pixel produces a lower sub-pixel luminance than does supplying the unmodified data value). Thus, according to the invention the data value for a sub-pixel of one colour in one pixel of a pair of pixels is modified in the opposite direction to the data value for a sub-pixel of that colour in the other pixel of the pair of pixels (as noted, the pair of pixels may be two pixels from one frame that are spatially close to one another, or may be two pixels from consecutive frames). Preferably the data values of the two sub-pixels are modified such that the increase in luminance of a sub-pixel of one colour in one pixel of the pixel pair is (as seen by an on-axis viewer) approximately equal in magnitude to the decrease in luminance of the sub-pixel of that colour in the other pixel of the pixel pair—that is, so that the average of the luminances of the two sub-pixels generated by their respective modified data values is equal to the luminance that would have been generated by the unmodified data value. (The luminance that is "generated by" a data value is the luminance of a sub-pixel of the display that is obtained when that data value is supplied to the sub-pixel.)

Where the invention is applied using two pixels from one frame that are spatially close to one another, the two pixels may be in the same pixel column as one another, or they may be in the same pixel row as one another.

As noted, the method of the invention produces no overall change in luminance and chrominance for a pixel pair, and also produces no significant change in the image perceived by an observer, but may lead to a change in luminance and/or chrominance for the individual pixels of a pixel pair. Accordingly, the method may comprise modifying the data values of sub-pixels in a pixel so as to minimise a change in overall luminance of the pixel to an on-axis viewer of the display panel, for example by modifying the data values of sub-pixels in a way that provides a lower change in overall luminance of the pixel than would other possible ways of modifying the data values of sub-pixels. Preferably the method comprises modifying the data values of sub-pixels in a pixel such that the overall luminance of the pixel appears substantially unchanged to an on-axis viewer of the display panel (this typically requires that the overall luminance of the pixel changes by no more than around 1%). These features minimise the change in luminance of individual pixels in a pixel pair, and so ensure there is little or no loss of image quality to an on-axis viewer while providing better image quality to an off-axis viewer.

The method may comprise modifying the data value of at least one sub-pixel of a pixel in an opposite direction to the data value of at least another sub-pixel of the pixel. This is effective to minimise the change in overall luminance of the pixel to an on-axis viewer of the display panel.

The method may comprise, for a pair of pixels, modifying the data values of corresponding sub-pixels in the pair of pixels so as to minimise a change in overall luminance of each pixel of the pair of pixels to an on-axis viewer of the display panel. Additionally or alternatively, the method may comprise, for a plurality of pair of pixels, modifying the data values of corresponding sub-pixels in the pairs of pixels on a pixel pair-by-pixel pair basis so as to minimise a change in overall luminance of each pixel of the pairs of pixels to an on-axis viewer of the display panel. In known methods of modifying data values the same modification pattern is applied to the data values for all pixel pairs of the image, and this will be effective to minimise the change in overall luminance of the display. However, even though the change in overall luminance of the display may be minimised in these prior art methods, there may still be a significant overall change in luminance for individual pixels. In this embodiment therefore the modification of data values is determined separately for a pixel pair (that is, on a pixel pair-by-pixel pair basis) rather than applying the same modification to the data values of all pixel pairs—that is, data values of corresponding sub-pixels in a first pair of pixels may be modified according to one modification scheme so as to minimise a change in overall luminance of each pixel of the first pair of pixels, while data values of corresponding sub-pixels in a second pair of pixels may be modified according to a second, different modification scheme so as to minimise a change in overall luminance of each pixel of the second pair of pixels. In this way the data values for one pixel pair may by modified in a different way to the data values for another pixel pair, so as to minimise (and preferably eliminate) any change in overall luminance of each pixel of the pair, for all pairs of pixels—while still ensuring that the change in overall luminance of the display to an on-axis observer is kept at zero. The modification of data values may in principle be determined separately for each pixel pair in an image.

Alternatively, the method may comprise, for a plurality of pair of pixels, modifying the data values of corresponding first sub-pixels in the pairs of pixels on a pixel pair-by-pixel pair basis and modifying the data values of corresponding second sub-pixels in the pairs of pixels in the same manner for a first pixel pair and for a second pixel pair. In some cases it may be preferable for the modifications of data values for some of the sub-pixels to be the same from one pixel pair to another, particularly for sub-pixels which make greatest contribution to luminance i.e. green and white/yellow sub-pixels, while allowing the modifications to the data values of other sub-pixels to change from one pixel pair to another pixel pair.

When the invention is applied to an RGBW display, the method may comprise, for a pair of pixels, modifying the data values of corresponding sub-pixels in the pair of pixels so as to minimise a change in overall chrominance of the pair of pixels to an on-axis viewer of the display panel. In general, in aspects and embodiments of the invention in which data values of corresponding sub-pixels from a pair of pixels are modified in opposite directions to one another an individual pixel may show an overall change in chrominance. In the case of an RGBW display, however, it may be possible to modify the data values of the corresponding sub-pixels in the pair of pixels so that individual pixels show little or no overall change in chrominance. This further ensures there is little or no loss of image quality to an on-axis viewer.

The method may comprise modifying data values for the primary sub-pixels and for the non-primary sub-pixel(s) such that the overall change in luminance of the primary sub-pixels is approximately equal and opposite to the overall change in luminance of the non-primary sub-pixel(s). This is effective to minimise a change in overall luminance of a pair of pixels.

The method may comprise, for a first pixel in the pair of pixels, modifying the data values for the primary sub-pixels in an opposite direction to the data value(s) for the non-primary sub-pixel(s). It may comprise, for a second pixel in the pair of pixels, modifying the data values for the primary sub-pixels in an opposite direction to the data value(s) for the non-primary sub-pixel(s), and comprising modifying the data values for the primary sub-pixels of the second pixel of the pair of pixels in an opposite direction to the data values for the primary sub-pixels of the first pixel of the pair of pixels.

Modifying data values may comprise, for at least one sub-pixel component, mapping each data value into at least two modified data values.

The average of the luminances generated by the modified values may be equal to the luminance generated by the unmodified value.

The method may comprise storing the at least two modified data values in a look-up table.

The method may further comprise outputting the modified sub-pixel colour component data values to a multi-primary display panel. For example, the method may be performed in a control circuit such as a source driver (eg the Source Driver ICs of FIG. 1, which may be separate from the display panel although it may alternatively be part of the display panel) or such as the Control ASIC of FIG. 1, which then provides the modified sub-pixel colour component data values to a multi-primary display panel. Alternatively the method may be performed in the multi-primary display panel itself, for example by in-pixel circuitry.

The two pixels of the pair of pixels may be spatially close to one another. Alternatively, a first pixel of the pair of pixels may occur in a first frame and a second pixel of the pair of pixels may occur in a second frame, the first and second frames being consecutive frames. (This is true for all aspects and embodiments of the invention in which data values for a pair of pixels are modified.)

As a further alternative, a first pixel of the pair of pixels may occur in a first group of frames and a second pixel of the pair of pixels may occur in a second group of frames, the first and second groups of frames being consecutive groups of frames (and including two or more frames). Again, the eye of an observer can average the luminance of the two pixels since the two pixels occur in consecutive groups of frames.

Where the pair of pixels occur in two different, but consecutive, frames or in two different, but consecutive, groups of frames changes to the data values of a sub-pixel may be co-ordinated with changes in drive polarity of the sub-pixel. It is known that certain display materials, for example a liquid crystal material, are preferably driven with an alternative drive polarity to ensure that there is no net dc voltage applied across the material—so, where the invention is applied to a display using such a material (such as liquid crystal display) it is preferable that the changes in data values for the sub-pixels are co-ordinated with changes in their respective drive polarity to ensure that there is no net applied dc voltage. (If, for example, a sub-pixel were always driven to have a greater luminance than would be generated by its unmodified data value when a positive drive voltage is applied and were always driven to have a lower luminance than would be generated by its unmodified data value when a negative drive voltage is applied, this would lead to a net dc voltage across the sub-pixel.) FIG. 28 shows one example of changes in data values for a sub-pixel being co-ordinated with changes in its drive polarity. The sub-pixel in the first column and first row is driven to have a greater luminance than would be generated by its unmodified data value in frames 1 and 2—and it is driven with a +ve polarity in frame 1 and a −ve polarity in frame 2 so that there is no net dc voltage applied in frames 1 and 2. Similarly there is no net dc voltage applied across this sub-pixel in frames 3 and 4, since it is driven to have a lower luminance than would be generated by its unmodified data value in frames 3 and 4, and is driven with a +ve polarity in frame 3 and a −ve polarity in frame 4. There is therefore no net dc voltage applied across this sub-pixel over the period of frames 1 to 4.

In an embodiment in which a first pixel of the pair of pixels occurs in a first group of frames and a second pixel of the pair of pixels occurs in a second group of frames, the timing of the change in data value for one sub-pixel may be different from the timing of the change in data value for another sub-pixel. It is not necessary for the changes in data value for every sub-pixel to occur at the end of the same frame. In the example of FIG. 28, for example, the sub-pixel in the first column and first row is driven to have a greater luminance than would be generated by its unmodified data value in frames 1 and 2, and is driven to have a lower luminance than would be generated by its unmodified data value in frames 3 and 4, whereas the sub-pixel in the second column and in the first row is driven to have a greater luminance than would be generated by its unmodified data value in frames 2 and 3, and is driven to have a lower luminance than would be generated by its unmodified data value in frames 1 and 4. That is, the timing of the change in data value for the sub-pixel in the first column and first row (at the end of frames 2 and 4) is different from the timing of the change in data value for the sub-pixel in the second column and first row (at the end of frames 1 and 3).

A second aspect of the invention provides a method of processing an image for display, the method comprising: receiving pixel data constituting an image, each pixel data including at least four sub-pixel colour components having respective data values and, for each of the pixel data, modifying one or more of the sub-pixel colour component data values; wherein the method comprises modifying data values for the primary sub-pixels of a pixel and for the non-primary sub-pixel(s) of the pixel such that the overall change in luminance of the primary sub-pixels is approximately equal and opposite to the overall change in luminance of the non-primary sub-pixel(s) whereby the overall luminance of the pixel and the perceived image appear substantially unchanged to an on-axis viewer.

The method may comprise modifying the data values for the primary sub-pixels and for the non-primary sub-pixel(s) such that the overall change in chrominance of the primary sub-pixels is approximately equal and opposite to the overall change in chrominance of the non-primary sub-pixel(s) whereby there is substantially no change in overall chrominance of the pixel to an on-axis viewer.

The method may comprise detecting whether a high spatial resolution feature is present in a region of the image; and, if so, reducing or preventing modifications to sub-pixel colour component data values for pixels in the region of the image. Applying the method of the invention to a high spatial resolution region of an image may cause colour artifacts, in particular in a moving image. Reducing the strength of the modifications to sub-pixel colour component data values for pixels in such a region, or making no modifications to sub-pixel colour component data values for pixels in such a region, can reduce or eliminate the risk of colour artifacts being generated.

The method may comprise: for a pair of pixels in the image, calculating metamers for the pair of pixels which have the same average luminance and chrominance as the unmodified data values for the pair of pixels and which have the same individual luminance as the unmodified data values; and selecting one of the metamers based on the calculated off-axis luminance and chrominance of the metamers. As noted above metamers are sets of data values that produce the same overall luminance and chrominance and, for a set of unmodified data values for a pair of pixels, metamers that provide the same overall luminance and chrominance (within some error limit) and that provide the same individual luminance (again within an error limit) may be calculated. The metamer that provides the best off-axis luminance and chrominance may then be selected, thereby minimising changes in the image perceived by an off-axis viewer.

A third aspect of the invention provides a method of processing an image for display, the method comprising: receiving pixel data constituting an image, each pixel data including at least three sub-pixel colour components having respective data values, for each of the pixel data, modifying one or more of the sub-pixel colour component data values, and outputting the modified sub-pixel colour component data values for display by a display panel; wherein the method comprises modifying the data values of corresponding sub-pixels from pixels in opposite directions to one another and such that the overall luminance of the display panel appears substantially unchanged to an on-axis viewer of the display panel; and wherein the method comprises, for a pair of pixels, modifying the data values of corresponding sub-pixels in the pair of pixels so as to minimise a change in overall luminance of the pair of pixels to an on-axis viewer of the display panel. The advantages described above for determining the modification of data values separately for a pixel pair (that is, on a pixel pair-by-pixel pair basis) apply also to a conventional three-colour display.

A fourth aspect of the invention provides a control circuit for a display, the control circuit being adapted to receive pixel data constituting an image, each pixel data including at least four sub-pixel colour components having respective data values; and for each of the pixel data, modify one or more of the sub-pixel colour component data values; and wherein the control circuit is adapted to modify the data values of corresponding sub-pixels from pixels in opposite directions to one another and such that the overall luminance of the display panel and the perceived image appear substantially unchanged to an on-axis viewer of the display panel.

A fifth aspect of the invention provides a control circuit for a multi-primary display panel, the control circuit being adapted to receive pixel data constituting an image, each pixel data including at least four sub-pixel colour components having respective data values; and for each of the pixel data, modify one or more of the sub-pixel colour component data values;

wherein the control circuit is adapted to modify data values for the primary sub-pixels of a pixel and for the non-primary sub-pixel(s) of the pixel such that the overall change in luminance of the primary sub-pixels is approximately equal and opposite to the overall change in luminance of the non-primary sub-pixel(s) whereby the overall luminance of the pixel and the perceived image appear substantially unchanged to an on-axis viewer.

A sixth aspect of the invention provides a control circuit for a display, the control circuit being adapted to carry out a method of the first, second or third aspect.

A seventh aspect of the invention provides a display comprising a control circuit of the fourth or fifth aspect and a multi-primary display panel, the control circuit being adapted to, in use, output the modified sub-pixel colour component data values to the multi-primary display panel.

An eighth aspect of the invention provides a multi-primary display panel adapted to receive pixel data constituting an image, each pixel data including at least four sub-pixel colour components having respective data values; and for each of the pixel data, modify one or more of the sub-pixel colour component data values;

wherein the display panel is adapted to modify the data values of corresponding sub-pixels from pixels in opposite directions to one another and such that the overall luminance of the display panel and the perceived image appear substantially unchanged to an on-axis viewer of the display panel.

A ninth aspect of the invention provides a multi-primary display panel adapted to receive pixel data constituting an image, each pixel data including at least four sub-pixel colour components having respective data values; and for each of the pixel data, modify one or more of the sub-pixel colour component data values;

wherein the display panel is adapted to modify data values for the primary sub-pixels of a pixel and for the non-primary sub-pixel(s) of the pixel such that the overall change in luminance of the primary sub-pixels is approximately equal and opposite to the overall change in luminance of the non-primary sub-pixel(s) whereby the overall luminance of the pixel and the perceived image appear substantially unchanged to an on-axis viewer.

A tenth aspect of the invention computer-readable medium containing instructions which, when executed by a processor, cause the processor to perform a method of the first or second aspect.

According to the present invention the method provided includes receiving pixel data constituting an image, each pixel data including at least four sub-pixel colour components having respective data values, for each of the pixel data, modifying the sub-pixel colour component data values, and outputting the modified image data for display by the LCD.

According to a particular aspect, the modifying step includes mapping each data value of at least one of the sub-pixel colour components into at least two modified data values which are displayed on the LCD in multiplexed manner, and which exhibit a combined luminance to an on-axis viewer that is equal or proportional to that of the at least one of the sub-pixel colour component data value.

With respect to another aspect, the modifying step is carried out in such a way so as to minimise the net change in luminance of each pixel in the image. This is done by selecting one of the at least two modified data values for each sub-pixel so that the change in luminance of one or more of the sub-pixels is approximately equally balanced by the change in luminance of one or more of the remaining sub-pixels.

Similarly with respect to another aspect, the modifying step is carried out in such a way so at to minimise the net change in chrominance of each pixel in the image. This is done by selecting one of the at least two modified data values for each of the primary sub-pixels so that the change in chrominance of primary sub-pixels is approximately equally balanced by the change in chrominance of one or more of the non-primary sub-pixels.

According to still another aspect, the at least two modified data values are displayed on the LCD via the corresponding pixel in either a time multiplexed manner or in a spatially multiplexed manner.

In accordance with another aspect, the mapping step includes utilising at least one LUT to map sub-pixel colour component data values to at least two modified data values.

According to yet another aspect, a method is provided for creating an LUT. The method includes populating the LUT with output pixel data for each of the plurality of groups of input pixel data, the step of populating including determining a set of available on-axis/off-axis luminance points for the display device, considering a line or lines covering the full range of on-axis luminance values and having different respective off-axis luminance characteristics, and selecting a plurality of the available luminance points along each of the lines, the selection being made to reduce an error function which depends at least in part on a distance between the point and the line concerned, and populating the LUT based on the pixel data required to produce the selected luminance points.

In yet another aspect, the method is carried out via computer software. A computer program stored on a computer-readable medium is provided which, when executed by a computer, carries out a method for reducing colour shift in relation to viewing angle in a multi-primary LCD. The method includes receiving a plurality of pixel data constituting an image, each pixel data including a plurality of sub-pixel colour components having respective data values, modifying the sub-pixel colour component data values and outputting these modified values.

Alternatively, according to another aspect, an apparatus is provided for reducing colour shift in relation to viewing angle in a multi-primary LCD. The apparatus includes an input for receiving a plurality of pixel data constituting an image, each pixel data including a plurality of sub-pixel colour components having respective data values; a modifying section which modifies the sub-pixel colour component data values and an output for outputting the modified data values.

In accordance with another aspect, the method includes a step of filtering the plurality of pixel data to detect and modify a feature in the received image to avoid an undesirable display result otherwise caused by the modifying of the sub-pixel colour component data values.

The present invention also has the added benefit of improving the motion blur performance of the multi-primary LCD.

The invention claimed is:

1. A method of processing an image for display, the method comprising:

obtaining pixel data constituting an image, wherein data for each pixel in the pixel data includes at least four sub-pixel colour components having respective data values, wherein the at least four sub-pixel colour components comprise only one of each of four different color components, modifying one or more of the sub-pixel colour component data values, and displaying the modified image on a display panel;

wherein the modification of the one or more of the sub-pixel colour component data values includes:

modifying relative to one another the data values of the sub-pixels for the same colour components from the given pair of pixels such that:

the data value for one sub-pixel for a given colour component in the pair of pixels is increased and the data value for the other sub-pixel for the given colour component in the pair of pixels is decreased; and a colour shift of the image perceived by an off-axis viewer is reduced and the overall luminance of the display panel appears to change by no more than 1% to an on-axis viewer of the display panel.

2. A method as claimed in claim 1 and comprising modifying the data values of sub-pixels in a pixel so as to minimise a change in overall luminance of the pixel to an on-axis viewer of the display panel.

3. A method as claimed in claim 2, and comprising modifying the data value of at least one sub-pixel of a pixel relative to the data value of at least another sub-pixel of the pixel such that the value of the at least one sub-pixel of the pixel is increased and the data value of the at least another sub-pixel of the pixel is decreased.

4. A method as claimed in claim 1, and comprising, for a pair of pixels, modifying the data values of corresponding sub-pixels in the pair of pixels so as to minimise a change in overall luminance of each pixel of the pair of pixels to an on-axis viewer of the display panel.

5. A method as claimed in claim 1 and comprising, for a plurality of pair of pixels, modifying the data values of corresponding sub-pixels in the pairs of pixels on a pixel pair-by-pixel pair basis so as to minimise a change in overall luminance of each pixel of the pairs of pixels to an on-axis viewer of the display panel.

6. A method as claimed in claim 1 and comprising, for a plurality of pair of pixels, modifying the data values of corresponding first sub-pixels in the pairs of pixels on a pixel pair-by-pixel pair basis and modifying the data values of corresponding second sub-pixels in the pairs of pixels in the same manner for a first pixel pair and for a second pixel pair.

7. A method as claimed in claim 1, wherein the display is an RGBW display, and comprising, for a pair of pixels, modifying the data values of corresponding sub-pixels in the pair of pixels so as to minimise a change in overall chrominance of the pair of pixels to an on-axis viewer of the display panel.

8. A method as claimed in claim 1 and comprising modifying data values for the primary sub-pixels and for the non-primary sub-pixel(s) such that the overall change in luminance of the primary sub-pixels is approximately equal and opposite to the overall change in luminance of the non-primary sub-pixel(s).

9. A method as claimed in claim 8 and comprising, for a first pixel in the pair of pixels, modifying the data values for the primary sub-pixels in an opposite direction to the data value(s) for the non-primary sub-pixel(s).

10. A method as claimed in claim 9 and comprising, for a second pixel in the pair of pixels, modifying the data values for the primary sub-pixels in an opposite direction to the data value(s) for the non-primary sub-pixel(s), and comprising modifying the data values for the primary sub-pixels of the second pixel of the pair of pixels in an opposite direction to the data values for the primary sub-pixels of the first pixel of the pair of pixels.

11. A method as claimed in claim 1 wherein modifying data values comprises, for at least one sub-pixel component, mapping each data value into at least two modified data values.

12. A method as claimed in claim 11 wherein the average of the luminances generated by the modified values is equal to the luminance generated by the unmodified value.

13. A method as claimed in claim 11 and comprising storing the modified data values into at least two modified data values in a look-up table.

14. A method as claimed in claim 1 and comprising outputting the modified sub-pixel colour component data values to a multi-primary display panel.

15. A method as claimed in claim 1 wherein the two pixels of the pair of pixels are spatially close to one another.

16. A method as claimed in claim 1 wherein a first pixel of the pair of pixels occurs in a first frame and a second pixel of the pair of pixels occurs in a second frame, the first and second frames being consecutive frames.

17. A method as claimed in claim 1 wherein a first pixel of the pair of pixels occurs in a first group of frames and a second pixel of the pair of pixels occurs in a second group of frames, the first and second groups of frames being consecutive groups of frames.

18. A method as claimed in claim 16 wherein changes to the data values of a sub-pixel are co-ordinated with changes in drive polarity of the sub-pixel.

19. A method as claimed in claim 17, wherein the timing of the change in data value for one sub-pixel may be different from the timing of the change in data value for another sub-pixel.

20. A method as claimed in claim 1, wherein the obtained image has the same resolution as the modified image.

21. The method of claim 1, further comprising, after compensating for the increase in the data value of the given sub-pixel:

within a given pixel of the pair of pixels, if a difference between the modified data values of the sub-pixels within the given pixel are greater than a given threshold, return the data values of the sub-pixels to their unmodified data values.

22. The method of claim 1, wherein the at least four sub-pixel colour components comprise only one red sub-pixel, only one blue sub-pixel, and only one green sub-pixel.

23. A method of processing an image for display, the method comprising:

receiving pixel data constituting an image, wherein data for each pixel in the pixel data includes at least four sub-pixel colour components having respective data values and each of the at least four sub-pixel colour components are either primary sub-pixels or non-primary sub-pixels, wherein the at least four sub-pixel colour components comprise only one of each of four different color components;

modifying one or more of the sub-pixel colour component data values; and displaying the modified image on a display panel;

wherein the modification of the one or more of the sub-pixel colour component data values includes:

modifying relative to one another the data values of the sub-pixels for the same colour components from the given pair of pixels such that:

the data value for one sub-pixel for a given colour component in the pair of pixels is increased and the data value for the other sub-pixel for the given colour component in the pair of pixels is decreased; and for the given pixel, modifying data values for the primary sub-pixels of the given pixel and for the non-primary sub-pixel(s) of the given pixel such that;

a colour shift of the image perceived by an off-axis viewer is reduced and the overall change in luminance of the primary sub-pixels is approximately equal and opposite to the overall change in luminance of the non-primary sub-pixel(s), such that an increase in the luminance of the primary sub-pixels results in a decrease in the luminance of the non-primary sub-pixel(s) and a decrease in the luminance of the primary sub-pixels results in an increase in the luminance of the non-primary sub-pixel(s);

the overall luminance of the pixel appears to change by no more than 1% to an on-axis viewer.

24. A method as claimed in claim 23, wherein the method comprises modifying the data values for the primary sub-pixels and for the non-primary sub-pixel(s) such that the overall change in chrominance of the primary sub-pixels is approximately equal and opposite to the overall change in chrominance of the non-primary sub-pixel(s) whereby there is no change in overall chrominance of the pixel to an on-axis viewer.

25. A method as claimed in claim 1, and comprising detecting whether a high spatial resolution feature is present in a region of the image; and, if so, reducing or preventing modifications to sub-pixel colour component data values for pixels in the region of the image.

26. A method as claimed in claim 23, and comprising detecting whether a high spatial resolution feature is present in a region of the image; and, if so, reducing or preventing modifications to sub-pixel colour component data values for pixels in the region of the image.

27. A method as claimed in claim 24 and comprising:

for a pair of pixels in the image, calculating metamers for the pair of pixels which have the same average luminance and chrominance and which have the same individual luminance as the input data; and selecting one of the metamers based on the calculated off-axis luminance and chrominance of the metamers.

28. A control circuit for a multi-primary display panel, the control circuit being adapted to receive pixel data constituting an image, wherein data for each pixel in the pixel data includes at least four sub-pixel colour components having respective data values, wherein the at least four sub-pixel colour components comprise only one of each of four different color components;

modify one or more of the sub-pixel colour component data values; and displaying the modified image on the multi-primary display panel;

wherein the control circuit is adapted to modify the data values of the one or more sub-pixel colour components, the modifying including:

modifying relative to one another the data values of the sub-pixels for the same colour components from the given pair of pixels such that:

the data value for one sub-pixel for a given colour component in the pair of pixels is increased and the data value for the other sub-pixel for the given colour component in the pair of pixels is decreased; and a colour shift of the image perceived by an off-axis viewer is reduced and the overall luminance of the display panel appears to change by no more than 1% to an on-axis viewer of the display panel.

29. A control circuit for a multi-primary display panel, the control circuit being adapted to receive pixel data constituting an image, wherein data for each pixel in the pixel data includes at least four sub-pixel colour components having respective data values and each of the at least four sub-pixel colour components are either primary sub-pixels or non-primary sub-pixels, wherein the at least four sub-pixel colour components comprise only one of each of four different color components;

modify one or more of the sub-pixel colour component data values; and displaying the modified image on the multi-primary display panel;

wherein the modification of the one or more of the sub-pixel colour component data values includes:

modifying relative to one another the data values of the sub-pixels for the same colour components from the given pair of pixels such that:

the data value for one sub-pixel for a given colour component in the pair of pixels is increased and the data value for the other sub-pixel for the given colour component in the pair of pixels is decreased; and for the given pixel, modifying data values for the primary sub-pixels of the given pixel and for the non-primary sub-pixel(s) of the given pixel such that;

a colour shift of the image perceived by an off-axis viewer is reduced and the overall change in luminance of the primary sub-pixels is approximately equal and opposite to the overall change in luminance of the non-primary sub-pixel(s), such that an increase in the luminance of the primary sub-pixels results in a decrease in the luminance of the non-primary sub-pixel(s) and a decrease in the luminance of the primary sub-pixels results in an increase in the luminance of the non-primary sub-pixel(s);

the overall luminance of the pixel appears to change by no more than 1% substantially unchanged to an on-axis viewer.

30. A display comprising a control circuit as defined in claim 26 and a multi-primary display panel, the control circuit being adapted to, in use, output the modified sub-pixel colour component data values to the multi-primary display panel.

31. A multi-primary display panel adapted to receive pixel data constituting an image, wherein data for each pixel in the pixel data includes at least four sub-pixel colour components having respective data values, wherein the at least four sub-pixel colour components comprise only one of each of three different color components;

modify one or more of the sub-pixel colour component data values; and display the modified image;

wherein the modification of the one or more of the sub-pixel colour component data values includes:

modifying relative to one another the data values of the sub-pixels from the same colour components from the given pair of pixels such that:

the data value for one sub-pixel for a given colour component in the pair of pixels is increased and the data value for the other sub-pixel for the given colour component in the pair of pixels is decreased; and a colour shift of the image perceived by an off-axis viewer is reduced and the overall luminance of the display panel appears to change by no more than 1% to an on-axis viewer of the display panel.

32. A multi-primary display panel adapted to receive pixel data constituting an image, wherein data for each pixel in the pixel data includes at least four sub-pixel colour components having respective data values and each of the at least four sub-pixel colour components are either primary sub-pixels or non-primary sub-pixels, wherein the at least four sub-pixel colour components comprise only one of each of four different color components;

modify one or more of the sub-pixel colour component data values; and display the modified image;

wherein the modification of the one or more of the sub-pixel colour component data values includes:

modifying relative to one another the data values of the sub-pixels for the same colour components from the given pair of pixels such that:

the data value for one sub-pixel for a given colour component in the pair of pixels is increased and the data value for the other sub-pixel for the given colour component in the pair of pixels is decreased; and for the given pixel, modifying data values for the primary sub-pixels of the given pixel and for the non-primary sub-pixel(s) of the given pixel such that;

a colour shift of the image perceived by an off-axis viewer is reduced and the overall change in luminance of the primary sub-pixels is approximately equal and opposite to the overall change in luminance of the non- primary sub-pixel(s), such that an increase in the luminance of the primary sub- pixels results in a decrease in the luminance of the non-primary sub-pixel(s) and a decrease in the luminance of the primary sub-pixels results in an increase in the luminance of the non-primary sub-pixel(s);

the overall luminance of the pixel appears to change by no more than 1% substantially unchanged to an on-axis viewer.

33. A non-transitory computer-readable medium containing instructions which, when executed by a processor, cause the processor to perform a method as defined in claim 1.

34. A non-transitory computer-readable medium containing instructions which, when executed by a processor, cause the processor to perform a method as defined in claim 23.

* * * * *